US008197319B2

(12) United States Patent
Nicely

(10) Patent No.: US 8,197,319 B2
(45) Date of Patent: Jun. 12, 2012

(54) GAMING SYSTEM AND METHOD FOR PROVIDING MULTIPLE BLACKJACK HANDS

(75) Inventor: Mark C. Nicely, Daly City, NV (US)

(73) Assignee: IGT, Reno, NV (US)

( * ) Notice: Subject to any disclaimer, the term of this patent is extended or adjusted under 35 U.S.C. 154(b) by 1250 days.

(21) Appl. No.: 11/938,034

(22) Filed: Nov. 9, 2007

(65) Prior Publication Data

US 2009/0124313 A1 May 14, 2009

(51) Int. Cl.
*A63F 9/24* (2006.01)

(52) U.S. Cl. ..... 463/12; 463/13

(58) Field of Classification Search ..... 463/12, 463/13

See application file for complete search history.

(56) References Cited

U.S. PATENT DOCUMENTS

| | | | | |
|---|---|---|---|---|
| 5,154,429 | A | 10/1992 | LeVasseur | |
| 5,257,789 | A | 11/1993 | LeVasseur | |
| 5,257,810 | A | 11/1993 | Schorr et al. | |
| 5,437,462 | A | 8/1995 | Breeding | |
| 5,636,842 | A | 6/1997 | Cabot et al. | |
| 6,007,424 | A | 12/1999 | Evers et al. | |
| 6,062,979 | A | 5/2000 | Inoue | |
| 6,406,023 | B1 | 6/2002 | Rowe | |
| 6,457,715 | B1 | 10/2002 | Friedman | |
| 6,491,302 | B1 | 12/2002 | Boylan et al. | |
| 6,726,427 | B2 | 4/2004 | Jarvis et al. | |
| 6,811,153 | B1 | 11/2004 | Ko | |
| 6,959,927 | B1 | 11/2005 | Jacobs et al. | |
| 6,969,316 | B2 | 11/2005 | Jarvis et al. | |
| 6,986,514 | B2 | 1/2006 | Snow | |
| 7,195,244 | B1 | 3/2007 | Feola | |
| 2003/0006555 | A1 | 1/2003 | Boylan et al. | |
| 2003/0114209 | A1 | 6/2003 | Ritner et al. | |
| 2005/0170875 | A1 | 8/2005 | Snow | |
| 2006/0084505 | A1 | 4/2006 | Yoseloff et al. | |
| 2010/0120483 | A1* | 5/2010 | Lutnick et al. | 463/12 |
| 2010/0312625 | A1* | 12/2010 | Miller et al. | 705/14.5 |
| 2011/0275432 | A1* | 11/2011 | Lutnick et al. | 463/25 |
| 2012/0034962 | A1* | 2/2012 | Amaitis | 463/13 |

OTHER PUBLICATIONS

Blackjackswitch.com, website <http://www.blackjackswitch.com> printed on Sep. 27, 2007, 5 pages.

* cited by examiner

*Primary Examiner* — Pierre E Elisca

(74) *Attorney, Agent, or Firm* — Neil, Gerber & Eisenberg LLP

(57) ABSTRACT

A gaming system having a multiple hand Blackjack game is provided. The Blackjack game includes four cards initial dealt to the player and four cards initially dealt to the dealer. First, the gaming system sets the four dealer cards to form a first two-card dealer hand and a second two-card dealer hand, according to a set of predetermined rules. Similarly, the player sets the four player cards to form a first two-card player hand and a second two-Card player hand. The gaming system reveals an upward in the first dealer hand and then enables the player to modify the first player according to predetermined Blackjack rules. The gaming device modified the first dealer hand according to predetermined Blackjack rules. If the first player hand beats the first dealer hand, the player wins an award. The gaming device resolved the second player and dealer hands in a similar fashion.

29 Claims, 25 Drawing Sheets

GAMING SYSTEM AND METHOD FOR PROVIDING MULTIPLE BLACKJACK HANDS

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

There are a variety of games to play in casinos and other gaming environments. Blackjack or Twenty-One is one commonly known game which includes a player playing against a dealer. Typically, a player is dealt a single hand and competes against a dealer hand. The winning hand is the hand which has the highest value and does not exceed the value of twenty-one. Under certain Blackjack rules and for certain play conditions, the player is allowed to split their initial two-card hand into two separate hands. When a player splits their hand, they are playing two separate Blackjack hands against a single dealer hand.

Other casino card games, such as Pai Gow Poker, include player interaction and decision making elements where a player can set the cards in one or more player hands. In one common variation of Pai Gow poker, the player can form two poker hands out of seven dealt cards. The two hands must be formed into a five-card poker hand and a two-card poker hand, where the five-card hand must rank higher than the two-card hand. In order for a player to win a round of play in Pai Gow Poker, the players five card hand must rank higher than the dealers five card hand and the players two card hand must rank higher than the dealer's two card hand. If the player wins, a 5% commission or "vig" is deducted from the players winnings. For example, a player who placed a $10 wager and won, would receive $9.50 for their win award in addition to having their wager returned. This corresponds to a $10.00 win minus a 5% vig of $0.50, yielding a $9.50 total pay. Many players dislike this pay mechanism. Similarly, this discourages players from making off sized wagers, such as betting $12.00, because of the difficulty for the casino dealer to pay deal with the small change required to make the correct pays. In Pai Gow Poker, there are a high percentage of rounds of play that result in the player tying or pushing with the dealer. The high number of ties can be tedious for certain players. Conventional Pai Gow Poker uses a 53 card deck which including one joker card. Unlike the most poker games that define the joker to take on the value of any other card to optimize a hand, Pai Gow has certain rules that allow a joker to complete a flush or a straight, otherwise the joker is evaluated as an Ace. Another Pai Gow Poker variation relative to most poker games, is in the evaluation of the hand with the values A-2-3-4-5. In standard poker, a hand with 2-3-4-5-6 (of different suits) would be evaluated as ranking higher than the hand A-2-3-4-5 (of non-matching suits). In Pai Gow Poker, A-2-3-4-5 is considered the $2^{nd}$ highest ranked straight, higher than 9-10-J-Q-K and just lower than the highest ranked straight, 10-J-Q-K-A. These rule differences from standard poker make Pai Gow Poker confusing for some players and therefore harder for novices to learn the game. However, some players enjoy the strategic and interactive aspects of Pai Gow Poker in being able to manipulate a set of dealt cards to form multiple player hands.

There is a need to increase the level of interest, excitement and intrigue associated with other types of card games such as in Blackjack games by allowing a player to set the cards in the initial player hands. There is also a need to provide improvements to, and interesting variations of, card-related games.

SUMMARY

Various embodiments of the present disclosure relate to a gaming system or gaming device providing a multiple hand Blackjack game, and methods of playing and operating a multiple hand Blackjack game at a gaming table or through a gaming system or gaming device. In various embodiments, the gaming system causes several cards to be dealt to the player and the player is able to set the multiple two-card initial player hands by selecting which of the cards should be placed in, moved to, or associated with each particular player hand. Similarly, the gaming system deals several dealer cards and forms a plurality of two-card dealer hands according to a predetermined set of rules. After the cards in the player hands and the dealer hands have been set, the gaming system enables the player to exercise at least some of the following options: hit, stand, split, double-down and/or surrender on the first player hand and in accordance with a set of Blackjack rules. After the player acts, the gaming system modifies the first dealer hand according to the rules. The second player and dealer hands are resolved in a similar fashion and the gaming system collects the wagers for any player losses and provides the player with an award for any player wins.

In an embodiment, in a play of the game, the gaming system deals a total of 2*N cards to each player and 2*N cards to the dealer, where N>=2. For example, in one embodiment, the gaming system deals four player cards to each player and deals a total of four dealer cards. In one embodiment, the gaming system initially deals the four player cards, visible to the player, in a player card area and four dealer cards, face-down in a dealer card area. That is, the gaming device enables the player to designate two of the cards of the four player cards to form a first two-card initial player hand, and designate the remaining two of the player cards to form the second two-card initial player hand. After the player has completed the setting of the player hand, the gaming device sets the dealer cards into a first dealer hand and a second dealer hand, according to a set of predetermined rules. The gaming device then causes a dealer Lip-card to be revealed in none, one, or both of the initial dealer hands. In one embodiment, predetermined rules for the gaming system to set the dealer hands provide that the gaming system does not use any information about the player's hands when setting the dealer hands. In another embodiment, information about the cards in the player's hands is used to by the gaming system to set the dealer hands. In certain embodiments, a random determination is used for certain dealer hand setting situations. For example, if the dealer cards include J♣, K♠, Q♥ and 6♦, one dealer hand will have to have a point total of sixteen while the other hand will have to have a point total of twenty. The hand with the point total of sixteen may be randomly assigned to the first hand or to the second hand. In another example, with the same set of dealer cards J♣, K♠, Q♥ and 6♦, for the dealer hand having the point total of sixteen, the gaming system randomly determines whether to assign the ten-value card as the up-card or the 6-value card. For a player playing optimal Blackjack strategy, a player may play his or her hand differently based upon whether the dealer's up card is a ten-value card or a six-value card. Random determination mechanisms for setting the dealer cards may be based on a number of mechanisms including but not limited to the order in which the dealer cards are dealt, a secondary random number generator such as an electronic random number generator (RNG) or a computer-based psuedo-random number generator (PRNG). In the case where a RNG or a PRNG is used for the random determination, the determination may be based on a uniform probability distribution or upon a weighted probability distribution, or upon some other probability distribution function.

In another embodiment, the setting of dealer cards considers information about prior player decisions. For example, with the dealer cards J♣,K♠,Q♥ and 6♦, which, as explained earlier, leads to one dealer hand with a point total of sixteen and another dealer hand with a point total of twenty: the former hand is much less likely to win against the player than the latter hand. Because the sixteen value hand is the weaker of the initial dealer hands, the gaming system bases the decision to assign the sixteen value hand (i.e., the weaker hand) to the first dealer hand or to the second dealer hand upon the player's history of assigning weaker and stronger hands to the first player hand.

In another embodiment, the gaming system sets the dealer cards prior to allowing the player to set the player cards. In one variation of said embodiment, the dealer cards remain face down until the player has set the players hands. In another variation of said embodiment, the dealer cards are revealed to the player when the gaming system sets the dealer cards prior to allowing the player to set the player's hands. In one embodiment, the gaming system reveals some number of dealer cards not equal to the total number of dealer cards to the player prior to the player setting the player card hands.

Certain embodiments feature a multi-stage betting structure. In one embodiment, the player makes an initial wager on the first player hand. After the player sees the four player and sets the cards in the first and second player hand, then the player has the option to place a wager on the second player hand. In one embodiment, the second wager must be exactly equal to the first bet.

Embodiments of the multiple hand Blackjack game may be provided by or played at a single gaming machine, a multiplayer gaming station or electronic table, each of a plurality of single gaming machines linked through a network to a progressive jackpot, at a live gaming table with a human dealer, or through the Internet or other data network. Although the game is suited for a single player playing against a single dealer, it should be appreciated that the Blackjack game may be a multiplayer game, such as at a live gaming table, as mentioned above. Other embodiments may be played remotely from the gaming establishment, such as games played on a personal computer, personal digital assistant (PDA), mobile gaming device, or cellular phone. In these embodiments, a program is installed by the player or by someone else on the computer or other digital device to enable the player to play the game remotely. Alternatively, the program does not need to be explicitly loaded onto the player device but could be available by standard browser or thin-client technology by connecting through the Internet or other data network by accessing one or more servers of the gaming system.

In a multiplayer game where the hands are dealt from a one or more decks of playing cards, in one embodiment, all of the player cards are dealt face-up and only one of the initial two dealer cards are dealt face-up. Accordingly, each of the players are able to view and consider the values of the other players' cards. In another embodiment, all player cards are dealt face down. In certain circumstances, in accordance with the dealer rules, the dealer may have additional information about the cards already dealt. For example, in a game having card tracking devices, the values of each of the dealt cards may be stored into a memory device associated with the gaming table. In this embodiment, a processor and display device aides the dealer in being able to choose cards to use in the first and second initial two-card dealer hands. In another embodiment, two or more decks of cards may be used.

Relative to the strength of the mechanism(s) selected for a given game definition to assure long-term casino profitability, advantageous-to-player rules may also be offered in order to somewhat counteract, though not eliminate, the casino profit advantage. Such advantageous-to-player rules include, but are not limited to, allowing the player to see some or all of the initial dealer cards before setting the cards in the first and second two-card player hands.

In various embodiments, the deck of cards may include jokers, wild cards, modifier cards, and the game may include other suitable ways to modify the cards in the player hand and the dealer hand.

In one embodiment, the Blackjack game is played at a live gaming table with a human dealer. The gaming table can accommodate at least one player, and preferably can accommodate a plurality of players. In one such embodiment, the Blackjack game is played with one or more conventional decks of fifty-two playing cards.

In one such table game embodiment, the gaming table or system includes suitable scanning or reading technologies or mechanisms that are capable of identifying the values of the dealer's cards or dealers cards and players cards. In one embodiment, the card identification system further includes a card tracking program. For example, where an optical reader is included in a card shoe, a card tracking program would be able to determine the number of cards dealt and at least partially determine what cards have been dealt to the different players based in part on the rules of the game. The scanning technologies or mechanisms may be optical, based on radio frequency identification or another suitable method.

Employing a tracking system in the table game or system enables an automated determination as to how the dealer should set the cards in the dealer hands. As mentioned above, the live dealer must make a relatively quick decision regarding optimal strategy. A tracking system would alleviate the live dealer from having to make a fast decision and would prevent potential strategic errors. These tracking devices reduce the distraction of the dealer from the primary Blackjack game. Therefore, various embodiments of the gaming system disclosed herein solves the technical problem of a human dealer not being able to make such quick and accurate strategic decisions in the plays of the game regarding which of the dealer cards to set into which of the dealer hands by providing a display which instructs the dealer where to set the dealer cards. In one embodiment, a gaming system which has knowledge of both player cards and dealer cards can signal which player hands outrank the corresponding dealer hands and can signal which players are to receive award payments.

Additional features and advantages are described herein, and will be apparent from, the following Detailed Description and the figures.

BRIEF DESCRIPTION OF THE FIGURES

FIG. 2B is a schematic diagram of the data network that one or more of the gaming devices of the present disclosure may be connected to.

DETAILED DESCRIPTION

The present disclosure may be implemented in various configurations for gaming machines, gaming devices or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices, In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
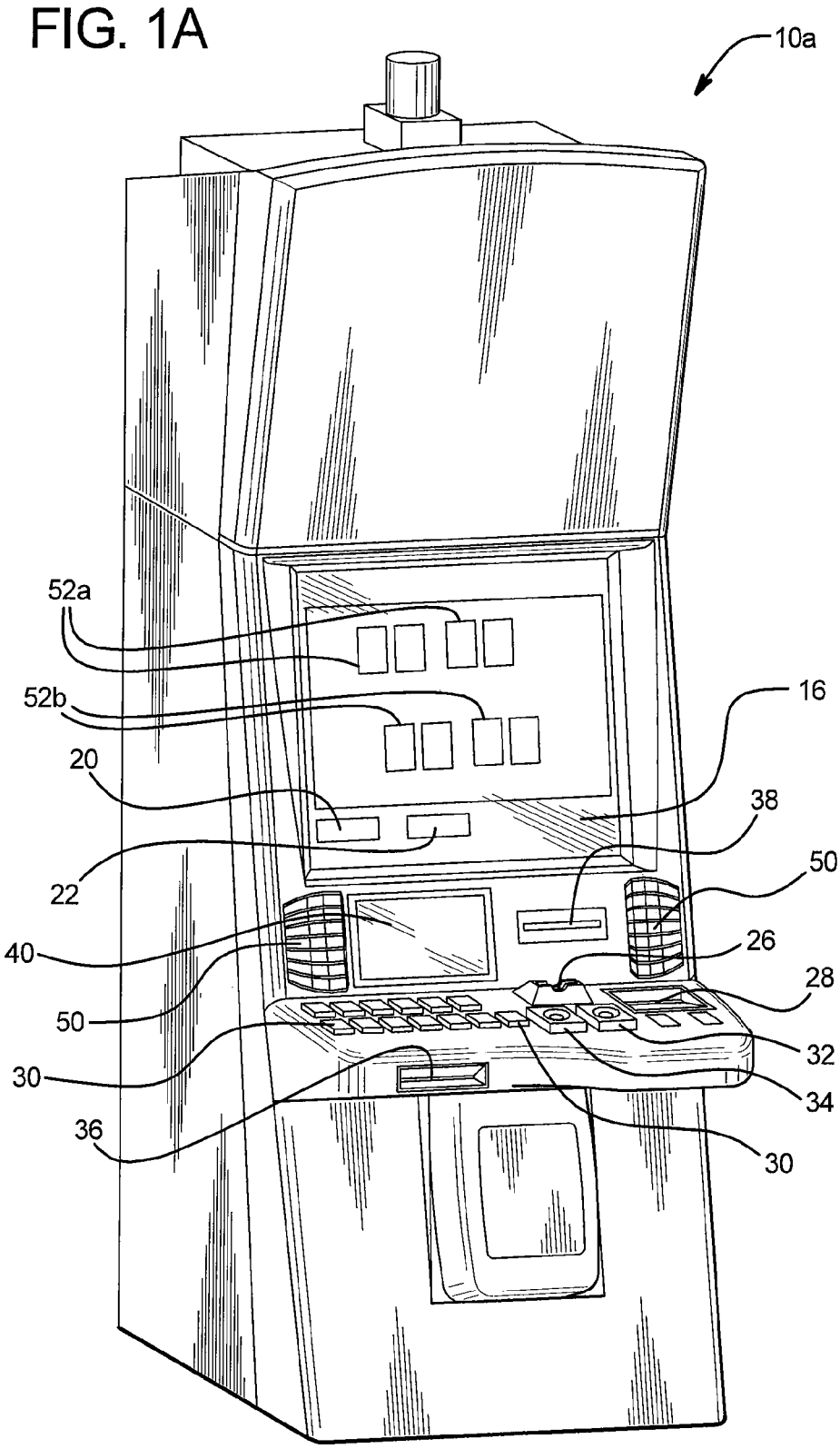
FIG. 1A is a front perspective view of one embodiment of the gaming system of the present disclosure.
Figure 1B:
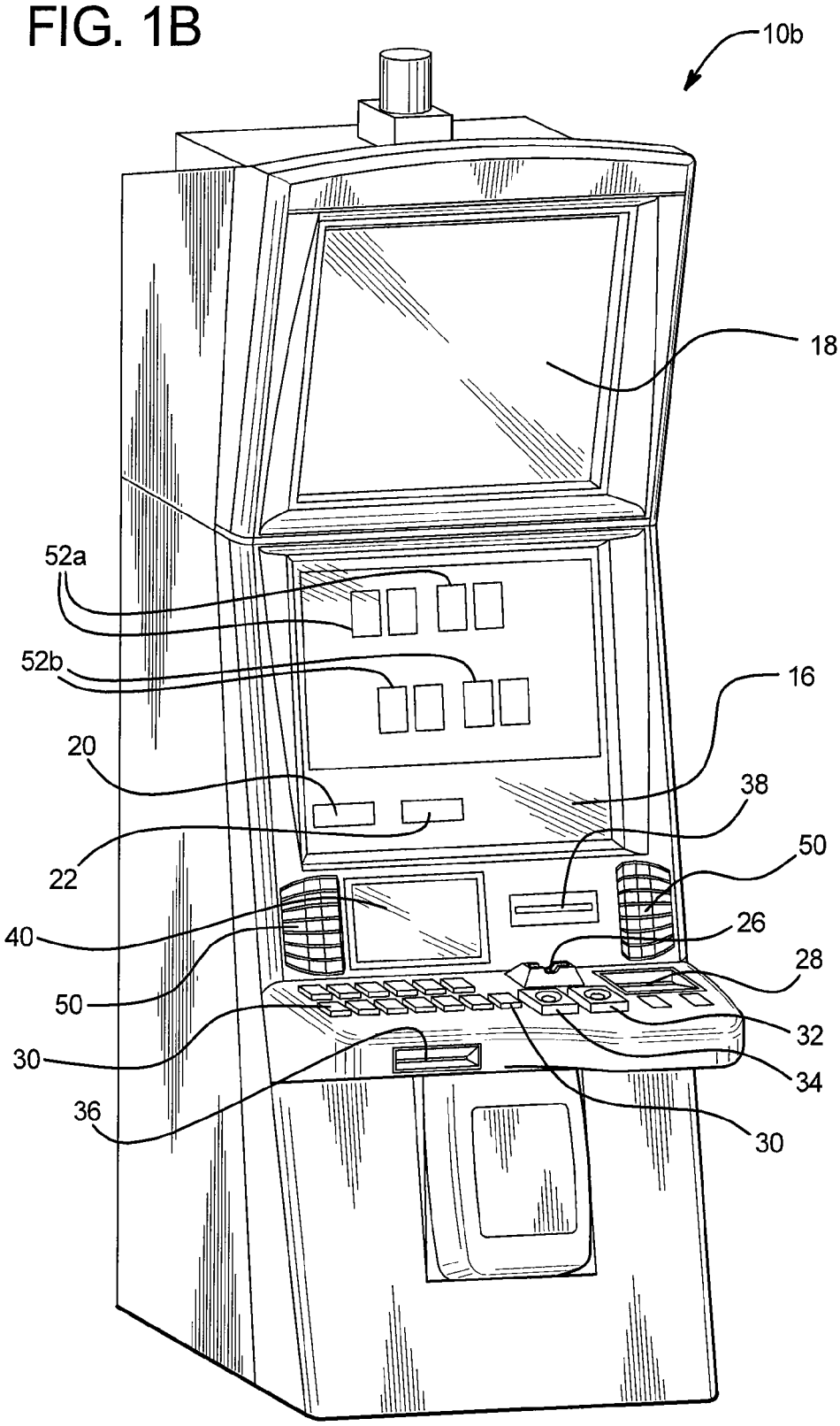
FIG. 1B is a front perspective view of one embodiment, of the gaming system of the present disclosure.

Referring now to the drawings, two example alternative embodiments of the gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 18, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
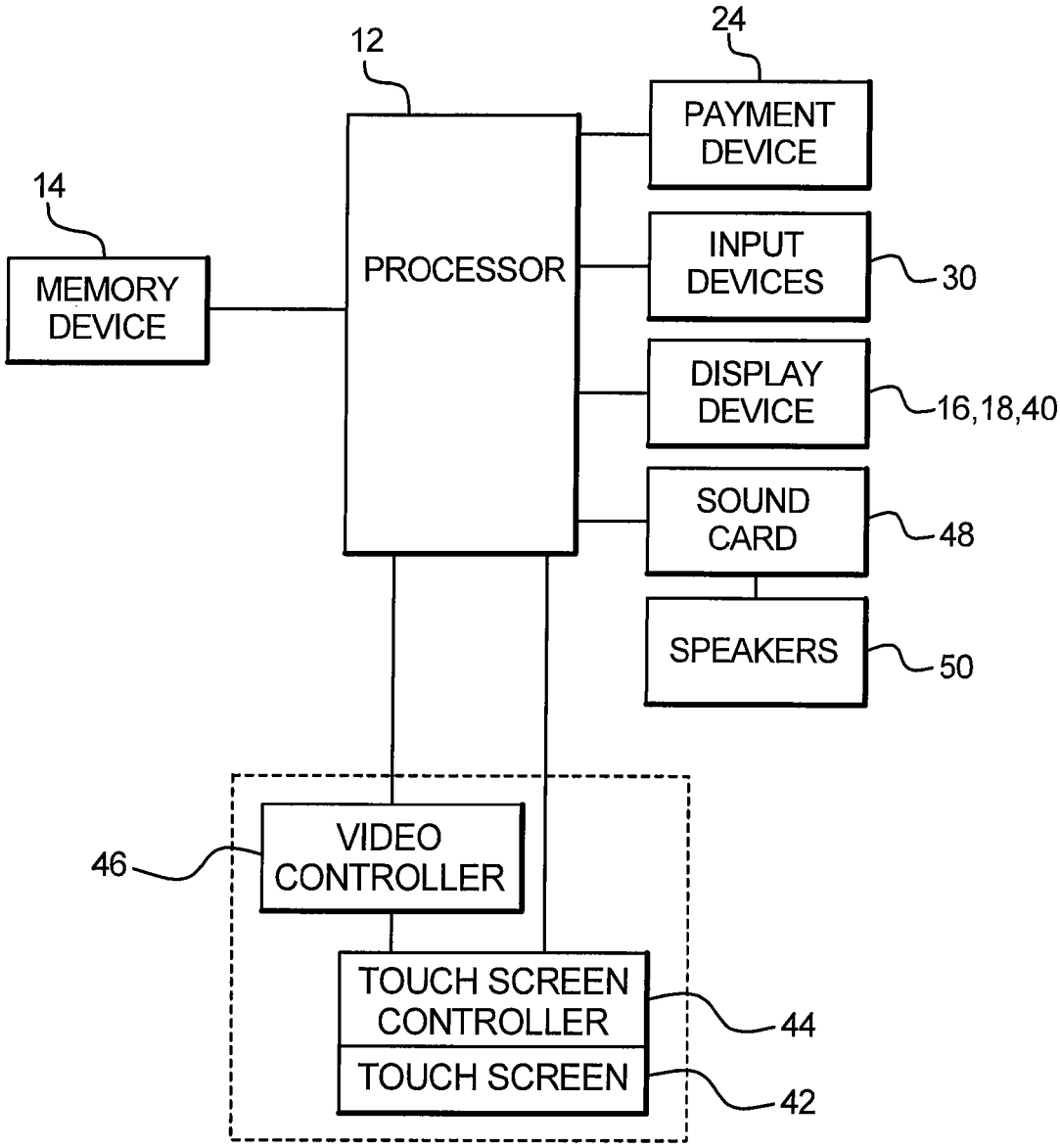
FIG. 2A is a schematic diagram of the electronic configuration of one embodiment of the gaming device of the present disclosure.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 18 includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a players playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as cards, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more cards, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment a player may insert an identification card into a card reader of the gaming device. In one embodiment, the identification card is a smart card having a programmed microchip or a magnetic strip coded with a players identification, credit totals (or related data) and other relevant information. In another embodiment, a player may carry a portable device, such as a cell phone, a radio frequency identification tag or any other suitable wireless device, which communicates a players identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the players electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable card game, cascading or failing symbol game, number game or other game of chance susceptible to representation in an electronic or electromechanical form, which in one embodiment produces a random outcome based on probability data at the time of or after placement of a wager. That is, different primary wagering games, such as video poker games, video Blackjack games, video keno, video bingo or any other suitable primary or base game may be implemented.

In one embodiment, as illustrated in FIGS. 1A and 1B, a base or primary game may be a multiple hand card game have one or more dealer hands 52*a* and one or more player hands 52*b*. In one embodiment, a base or primary game is a multiple hand Blackjack game having a plurality of player hands and a plurality of dealer hands. In certain of these Blackjack embodiments, the gaming system or gaming device enables the player to at least play a first player hand against a first dealer hand, and play a second player hand against a second dealer hand. The gaming system enables the player to play, for each of the player hands, a conventional game of Blackjack. The gaming system initially deals two cards for each of the player hands and the dealer hands from one or more fifty-two card virtual decks. Cards may be dealt as in a traditional game of cards or in the case of the gaming device, may also include that the cards are randomly selected from a predetermined number of cards. If the player wishes to hit, stand, double-down, split cards, or take an insurance option, the player selects the cards to hold via one or more input devices, such as pressing related hit stand, double-down, split, or insurance buttons or via the touch screen. The gaming device modifies the dealer hands according to a set of Blackjack rules and compares the final first player hand to the first dealer hand and compares the second player hand to the second dealer hand to determine winnings, The gaming device provides the player with an award based on any winning hands and the credits the player wagered. It should be appreciated that in certain embodiments, the Blackjack game may be a single hand Blackjack game or may be a multiple hand Blackjack game that includes more than two player and dealer hands.

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as certain cards appearing the player and/or dealer hands in the primary multiple hand Blackjack game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
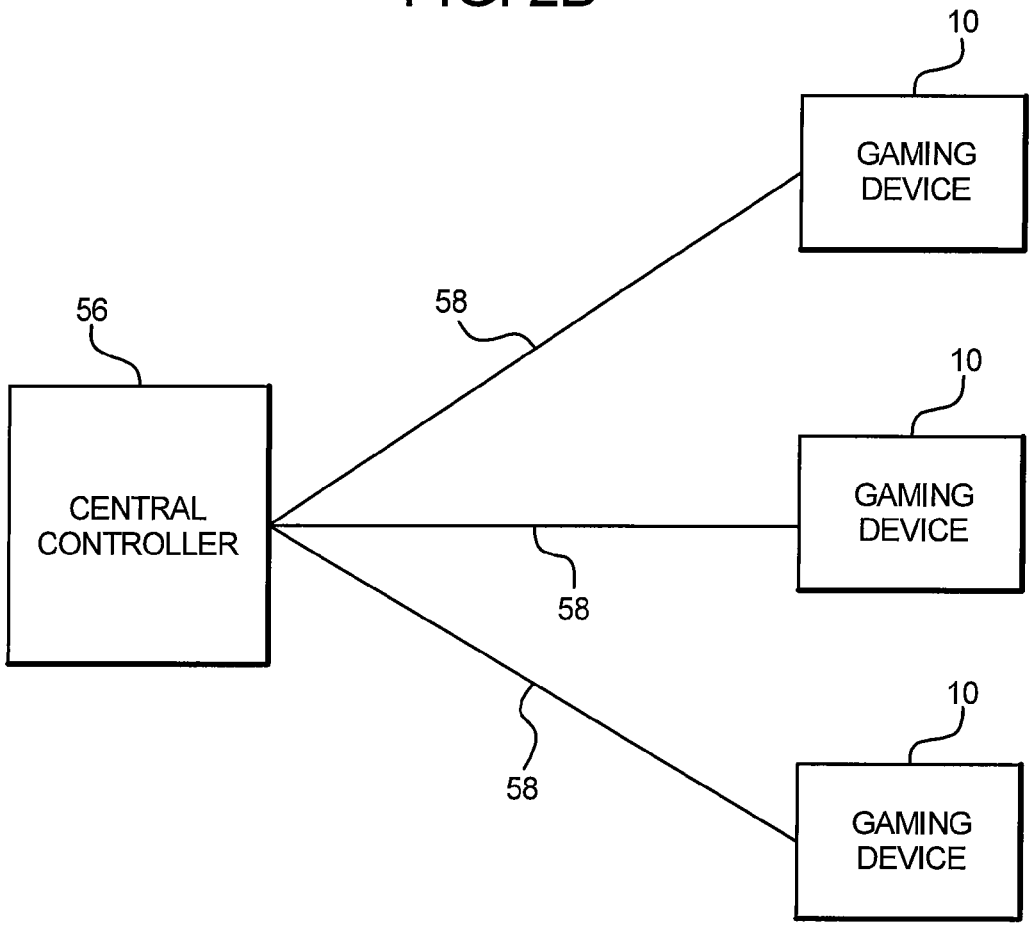

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified players gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the players birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device, in alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards.

In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events. In one example, where the base game is a multiple hand Blackjack game, a progressive award win is triggered based on a combination of player cards and/or dealer cards. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or card combination triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on players wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the groups. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

MULTIPLE HAND BLACKJACK GAMING SYSTEM

Figure 3A:
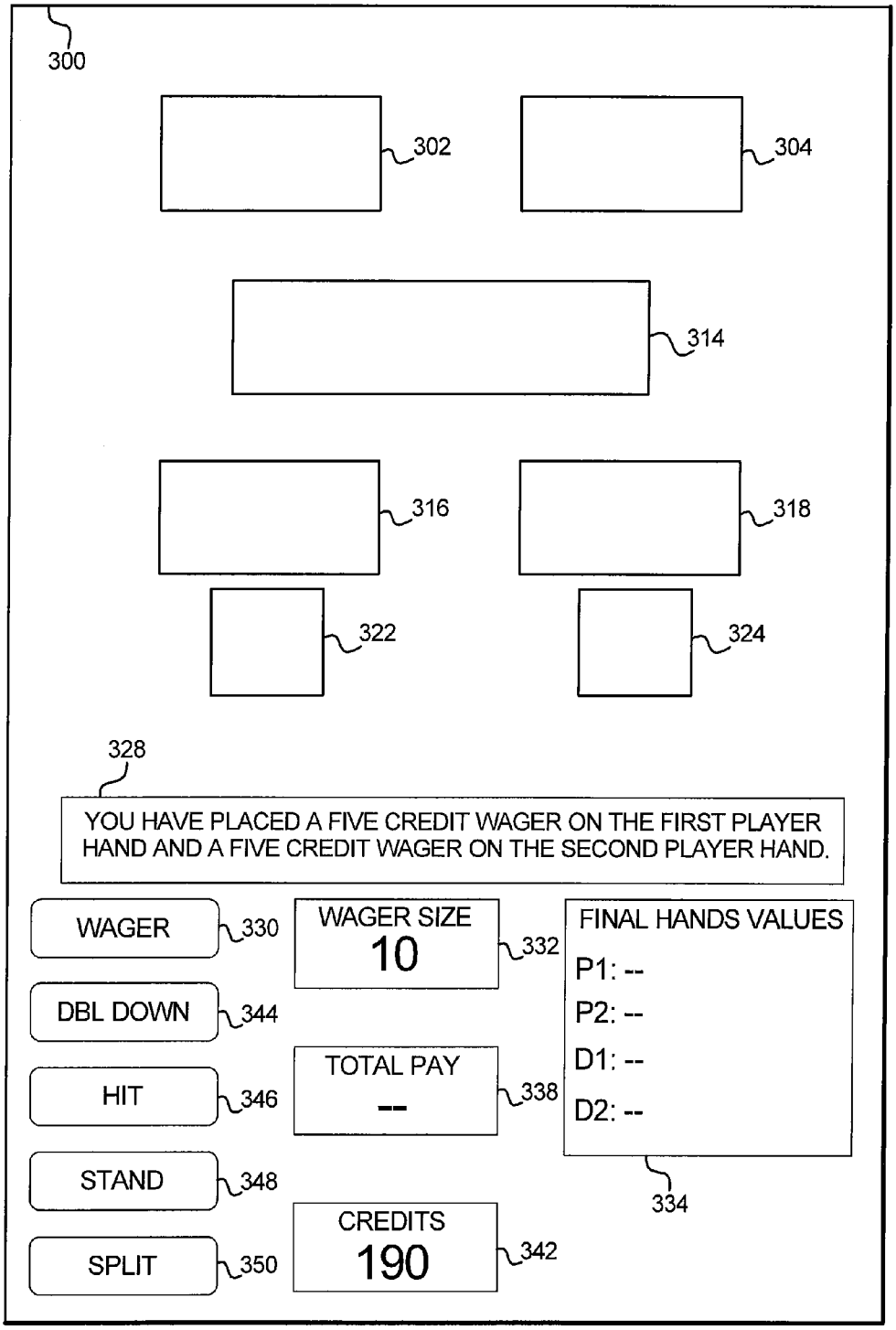
FIGS. 3A, 3B, 3C, 3D, 3E, 3F, 3G, 3H, 3I, 3J, 3K and 3L are top views of an example round of play of one embodiment of the Blackjack game, where the gaming system enables the player to set four player cards to form first and second player hands.

An example embodiment of a multiple hand Blackjack game is described with respect to FIGS. 3A to 3L. As shown in FIG. 3A, the gaming system 300 includes a display having a number of elements. The display includes a first dealer hand 302 area, a second dealer hand 304 area, a card area 3144 a first player hand 316 area, a second player hand 318 area, a first wager area 322, and a second wager area 324. The display also includes a message display 328, a pot size display 332, an award display 338, a total credits display 342, and a final hand value display 334. The gaming system 300 also includes a number of inputs. In the embodiment shown in FIG. 3A, these inputs include a wager input 330, a double down input 344, a hit input, 346 and a stand input 348. However, it should be appreciated that in other embodiments the gaming system 300 may include additional or different display and/or input elements on the display device in accordance with a play of a Blackjack game.

In the example embodiment described with respect to FIGS. 3A to 3L, the gaming system includes a set of Blackjack player rules that allow, for each of the two player hands: (a) splitting of cards once if the initial two cards in the two-card player hand are of the same rank; (b) doubling-down of the initial wager; and (c) if the two player cards have been previously split, no doubling-down of the initial wager after splitting the cards into two separate player hands. In this example embodiment, the gaming system 300 includes Blackjack dealer rules that: (a) require a hit to the dealer hand if the total value of the cards in the dealer hand is less than seventeen; (b) prevent a hit to the dealer hand if the dealer hand is a soft-seventeen (i.e., where the dealer hand includes at least one Ace that is counted as an eleven value card) or higher soft total less than twenty-two; and (c) prevent a hit to the dealer hand if the total value of the cards in the dealer hand is a hard seventeen (where there is no Ace that is counted as an eleven value card) or greater. However, it should be appreciated that the player and dealer rules may be altered in accordance with local gaming regulations or based on differing house rules.

As shown in FIG. 3A, the gaming system 300 initiates a round of play of the game. Although not shown in FIG. 3A, the gaming system 300 initially prompts the player to place an initial wager on the first player hand 316 and the second player hand 318. In this example, play of the game, the player elected to place a five credit wager on the first player hand 316 and a five credit wager on the second player hand 318, as indicated in the message display 328, and as also indicated in the first wager area 322 and the second wager area 324. In certain embodiments, the values of the wagers placed on the two player hands must be the same amount. In other embodiments, the values of the wagers placed on the two player hands may be different. The gaming system adjusts the total amount of player credits down from an original amount of 200 credits down to 190 credits, as indicated in the total credits display 342. The gaming system 300 also indicates an initial pot size of ten credits, as shown in the pot size display 332. The pot size represents the total value of the wagers placed by the player on both of the two player hands.

Figure 3B:
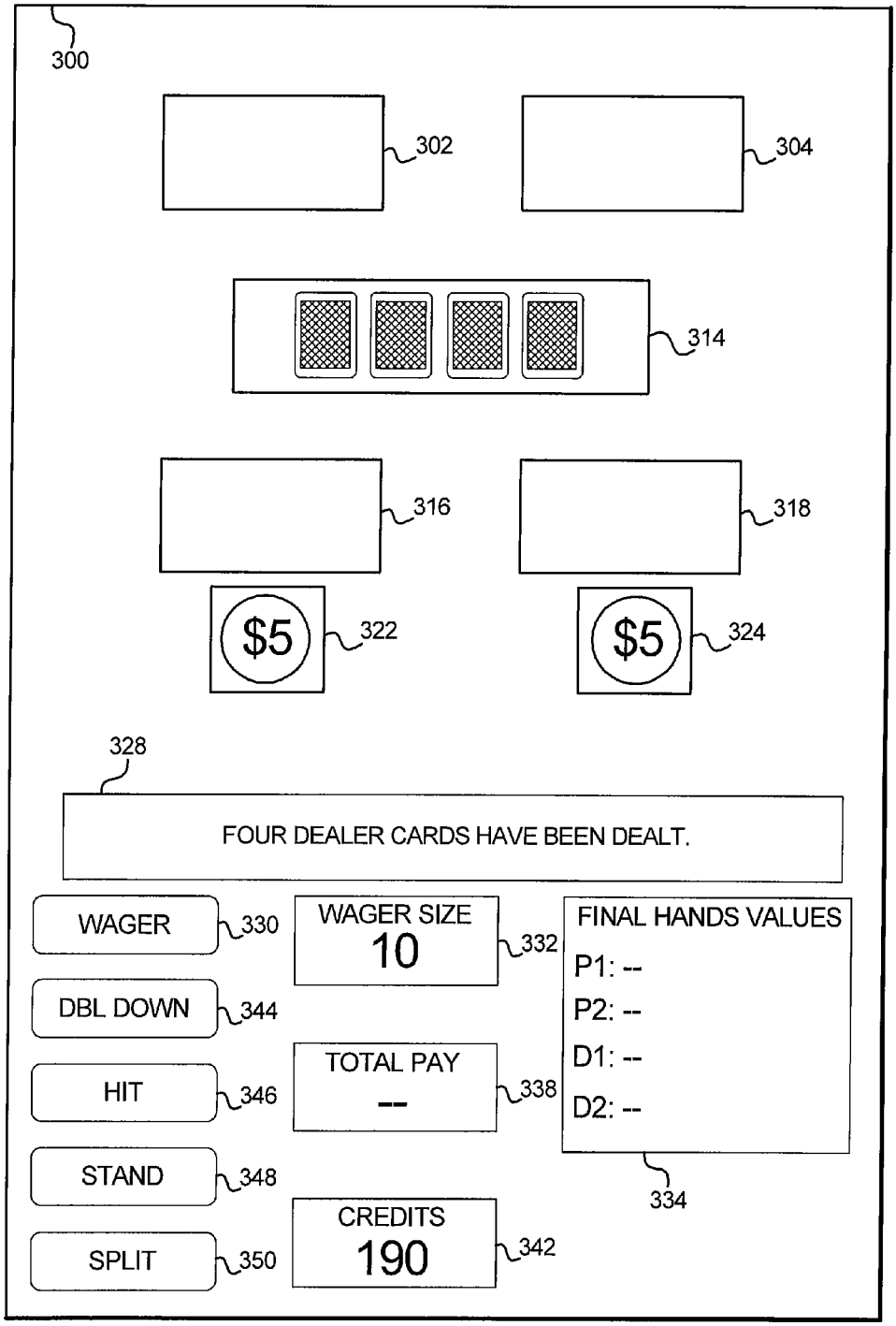

As shown in FIG. 3B, the gaming system 300 deals a plurality of dealer cards into the card area 314. In this embodiment, a play of the game includes the gaming system 300 dealing four dealer cards into the card area 314 such that four dealer cards can be individually selected and moved to one of the first dealer hand 302 and the second dealer hand 304. Likewise, as described in detail below, after the gaming system 300 has set the two dealer hands, the gaming system 300 deals four player cards into the card area 314, such that the player can individually select the player card to be moved to one of the first player hand 316 and the second player hand 318. As shown in FIG. 3B, the gaming system 300 indicates to the player that four dealer cards have been dealt, as indicated in the message display 328. In this embodiment, the dealer cards are initially dealt face-down, as shown in FIG. 38.

Figure 3C:
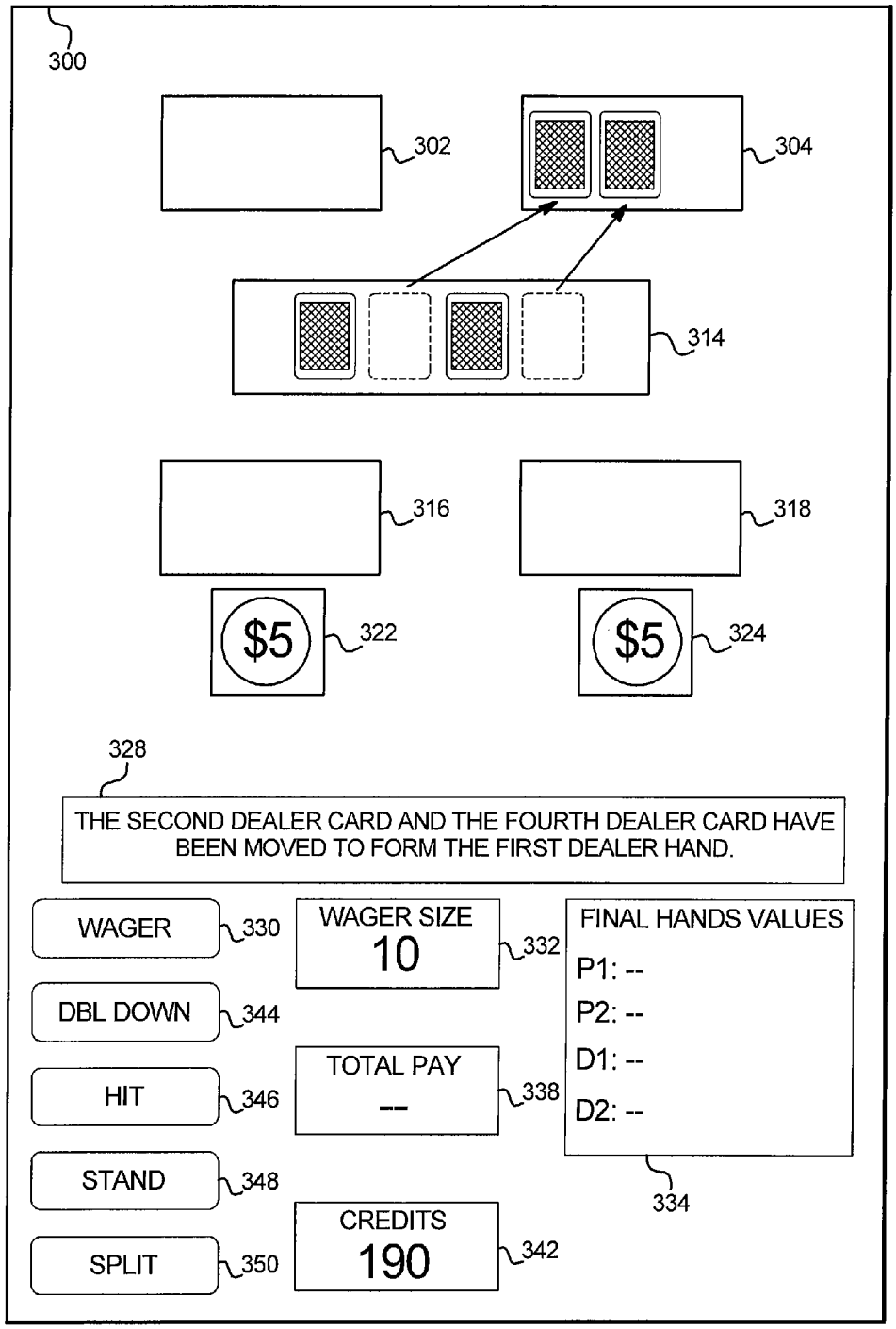

As shown in FIG. 3C, the gaming system 300 causes two of the dealer cards to be moved from the card area 314 into the second dealer hand 304. In this embodiment, the four dealer cards are dealt face-down such that the player does not know the identity of the four dealer cards. However, it should be appreciated that in other embodiments one or more of the dealer cards may be dealt face-up or otherwise the values of same may be made available to the player. In this example, the gaming system 300 causes the second dealer card and the fourth dealer card to be moved from the card area 314 to form the first dealer hand 304, as also indicated in the message display 328.

Figure 3D:
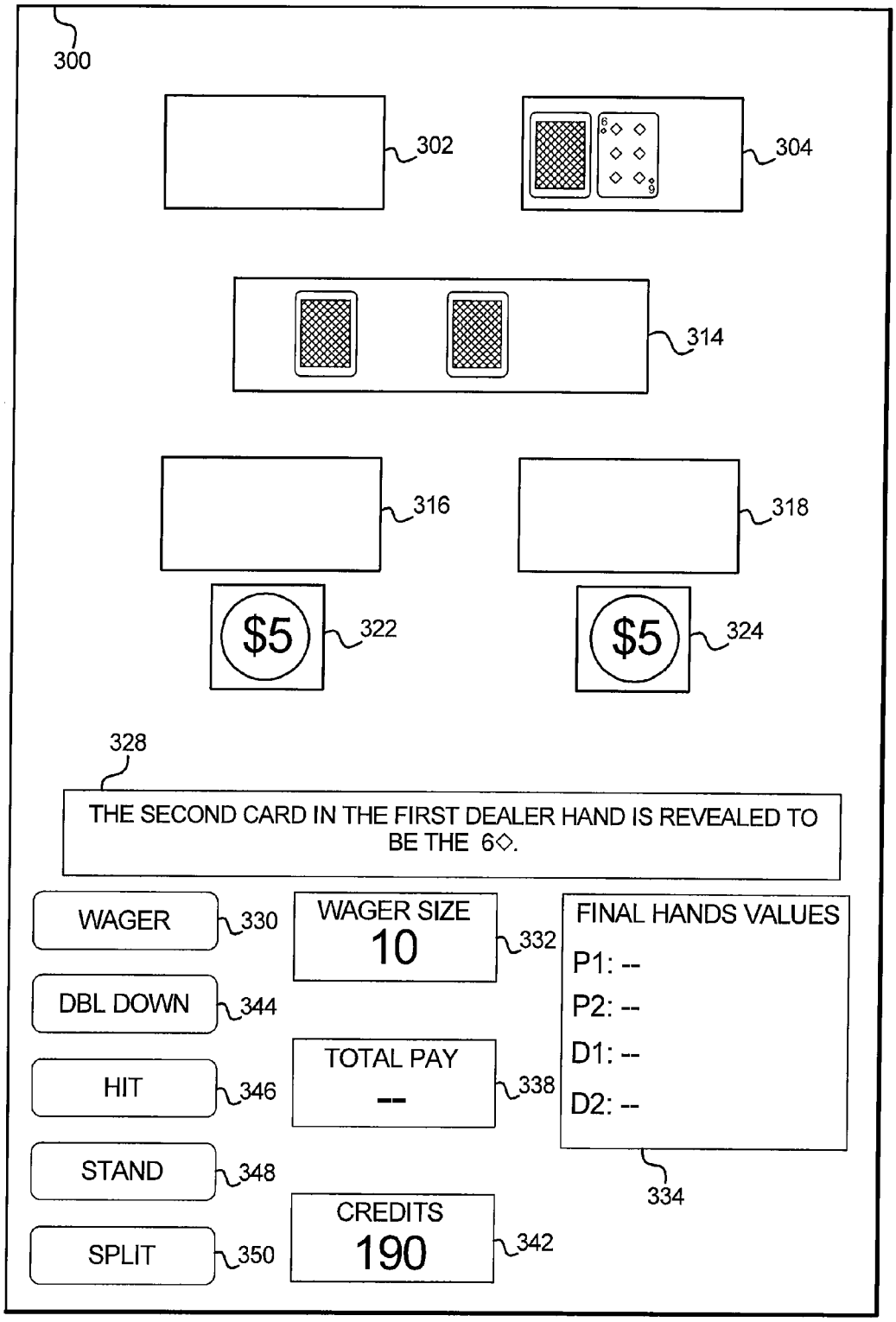

As shown in FIG. 3D, after the first dealer hand 304 has been formed, the gaming system 300 causes one of the cards in the first dealer hand 304 to be revealed to the player, as also indicated in message display 328. In this example, the second card in the first dealer hand 304 is revealed to be the 6♦. In this embodiment, the value of the second card in the first dealer hand 304 is revealed prior to moving the remaining two dealer cards from the card area 314 to form the second dealer hand 302. However, it should be appreciated that in other embodiments, the gaming system 300 sets all four of the dealer cards to form both of the dealer hands prior to revealing one of the cards in the first dealer hand 304. It should be appreciated that revealing one of the cards in the first dealer hand 304 prior to enabling the player to act on the player hand is consistent with generally accepted Blackjack rules. That is, one of the dealer cards is revealed to the player prior to the player having to make a decision whether or not to hit, double-down or stay in. However, it should be appreciated that in other embodiments, none of the dealer cards are revealed to the player until the player has set each of the four player cards to form the first player hand 318 and the second player hand 316.

Figure 3E:
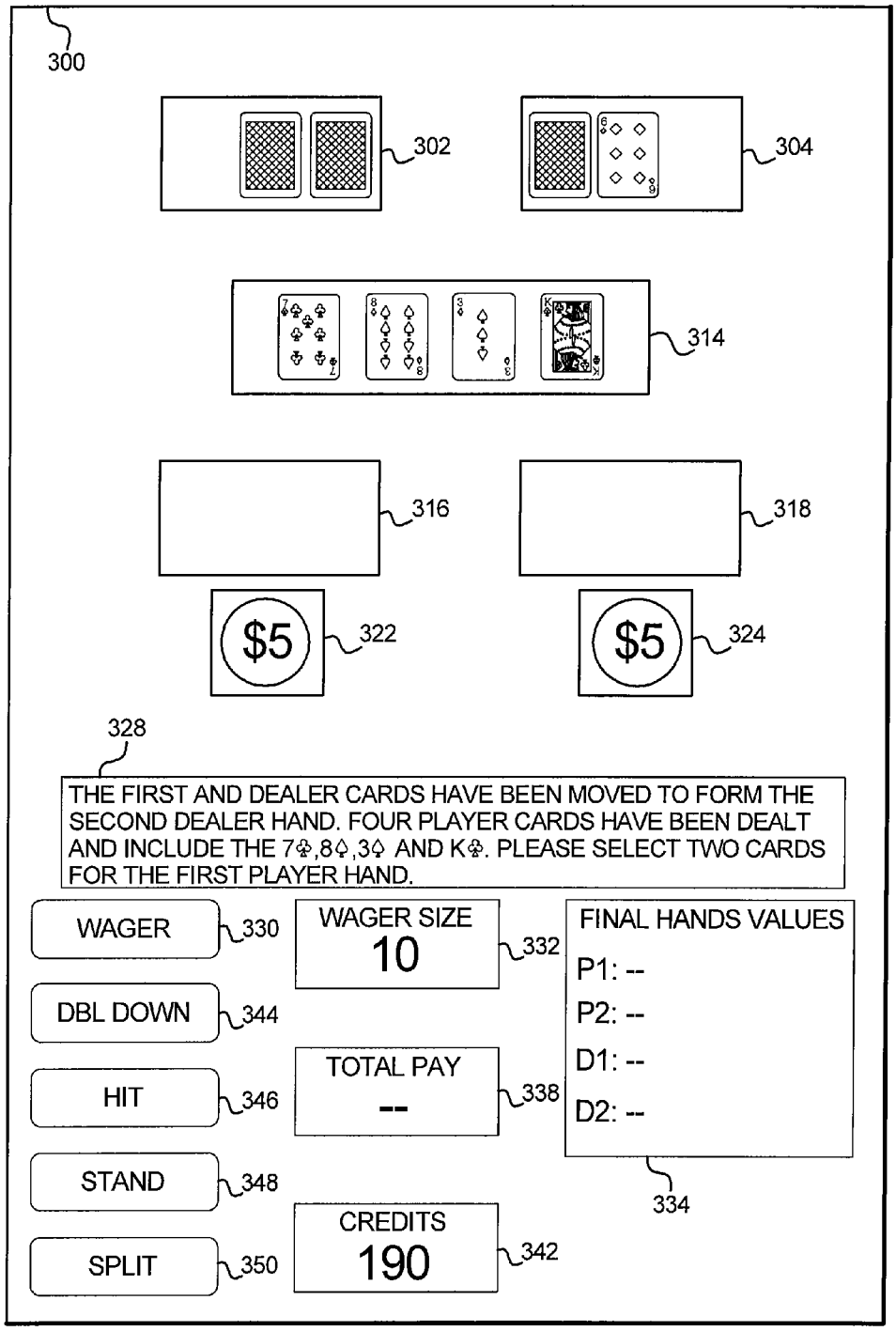
Figure 3F:
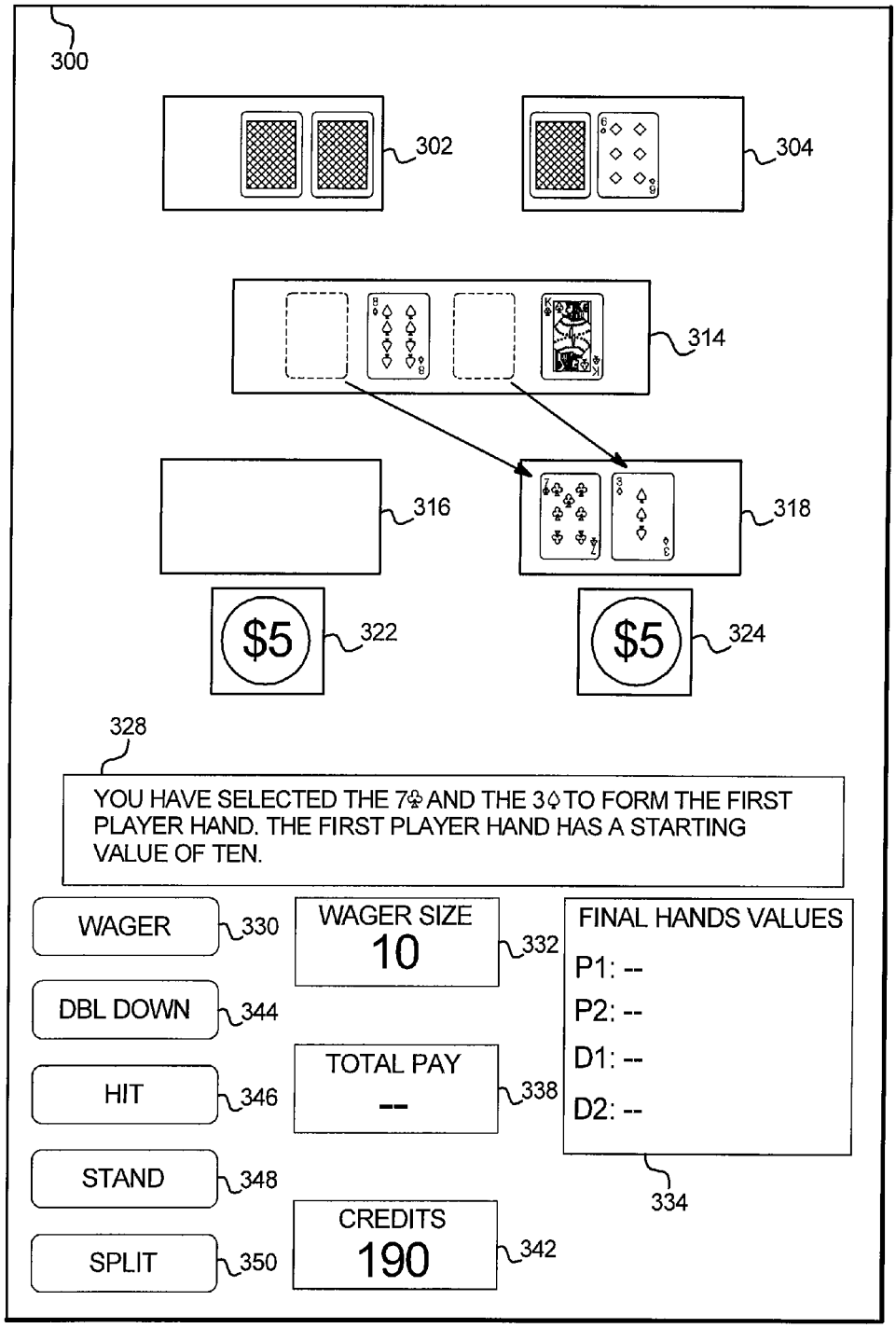

As shown in FIG. 3E, the gaming system 300 causes the remaining first and third dealer cards to be moved from the card area 314 to the second dealer hand 302, as also indicated in the message display 328. None of the cards in the second dealer hand 302 are revealed to the player prior to setting the cards in the player hands. The gaming system 300 then causes four cards to be dealt into the card area 314 that are the four player cards. In this example play of the game, the fourth player cards include the 7♣, 8♠, 3♠, and K♣. The gaming system 300 prompts the player to select two of the player cards to form the first player hand 318. As shown in FIG. 3F, the player has selected the first player card, which is a 7♣, and the third player card, which is a 3♠, to form the first player hand 318. Therefore, the first player hand has a starting value of ten, as also indicated in the message display 328.

It should be appreciated that a player can pick cards from among the four player cards to form strategically paired starting Blackjack hands. For example, it is generally considered advantageous for a player to have starting hand close to a value of 10 or close to a value of 20, and generally it is advantageous for the player to have a starting hand that ranges from 2-6 or from 12-16. Moreover, the cards may be strategically selected to give the player a double-down or splitting opportunity. For example, if the player is dealt a 4♥, 8♥, 7♣, and 8♠, and selects the 8♥ and 8♠, to form the first player hand, and selects the 4♥ and 7♣, to form the second player hand, the player has both a double-down opportunity and a hand splitting opportunity. In the first player hand, the player may choose to split the eights to form two separate hands. In the second player hand the player has an opportunity to double down (i.e., the 4♥ and 7♣, result in an initial hand value of eleven). It should be appreciated that in other embodiments, the gaming system may include more restrictive splitting and double-down rules to ensure or control an overall advantage to the gaming establishment.

Referring again to FIG. 3F, as mentioned above, the player selected the 7♣, and the 3♠, to form the first player hand 318, in this example, if the player would have selected the 7♣, and 8♠, for the first player hand 318, the player would have a relatively poor starting hand at only a value of fifteen. With a starting hand value of fifteen, the player would be more likely to bust if the player hits. Likewise, if the player would have selected the 3♠, and K♣, to form the second player hand 316, the player would have also had a relatively poor starting second player hand 316 having a value of thirteen (which also has a relatively high risk of busting on a hit). It should also be appreciated that, although in FIG. 3F the values of the four dealer cards are not yet revealed, the gaming system 300 includes programming logic to prioritize the setting of cards in the first dealer hand 304 and the second dealer hand 302 in order to optimize the values of the respective starting dealer hands. In some embodiments, algorithms are used to select how the dealer hands are assigned to be the first dealer hand and the second dealer hand. Such algorithms may use some of the following mechanisms: (a) published house rules; (b) random determination; (c) information about the player cards; (d) information about the player hands setting; (e) and information about prior player play history. In certain embodiments, algorithms are used to select which of the two cards in each dealer hand will become the dealers up-card. Such algorithms may use some of the following mechanisms; (a) published house rules; (b) random determination; (c) information about the player cards; (d) information about the player hands setting; and (e) information about prior player play history.

Figure 3G:
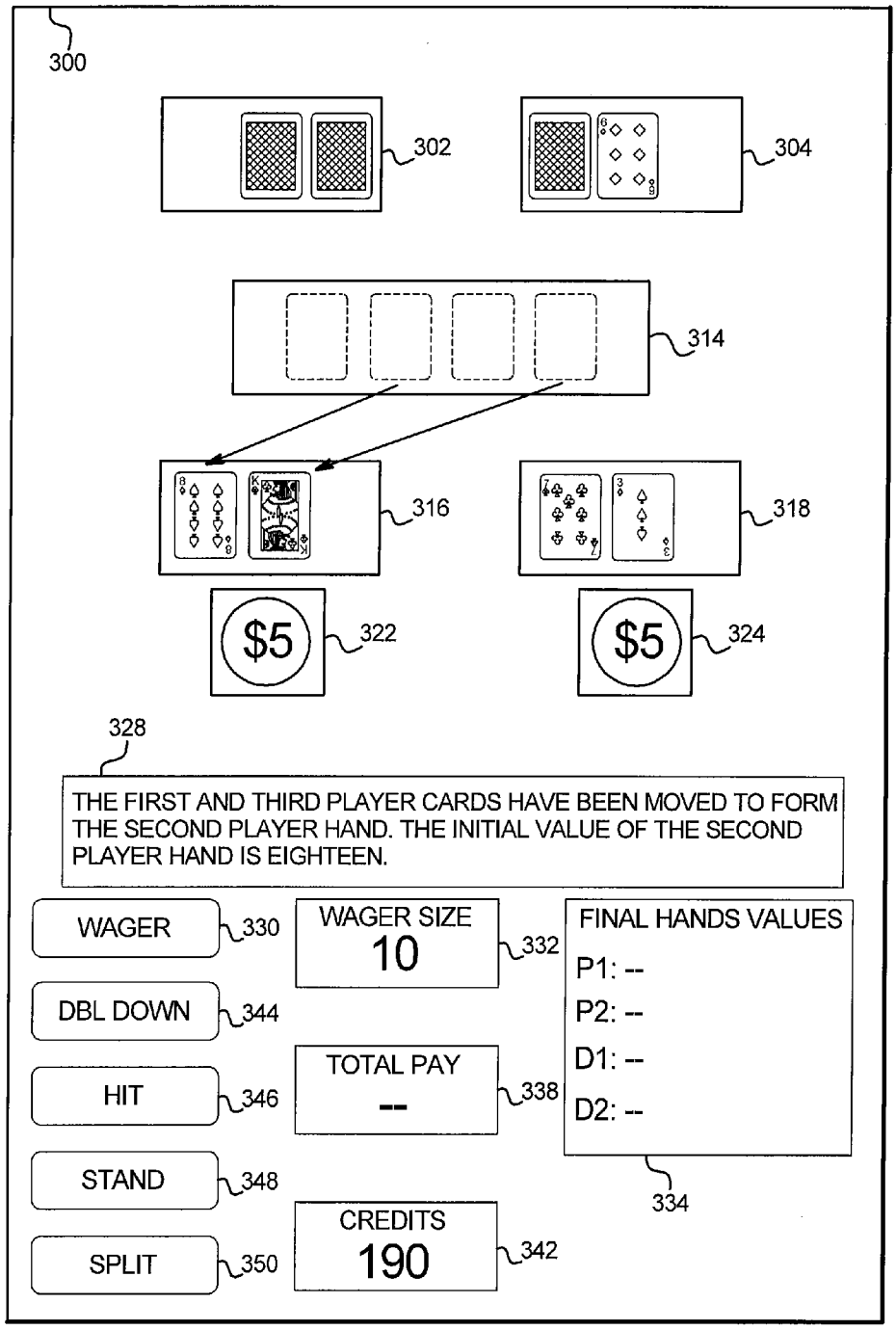

As shown in FIG. 3G, because the player has already moved the first and third player cards to form the first player hand 318, and because only two player cards remain in the card area 314, the gaming system 300 causes the remaining two player cards to automatically be moved to form the second player hand 316. In this example play of the game, the second player card, which has a value of the 8♠, and the fourth player card, which has a value of the K♣, have been caused to move to form the second player hand 316 totally eighteen, as also indicated by the message display 328 and the directional arrows pointing from the card area 314 to the second player hand 316.

Figure 3H:
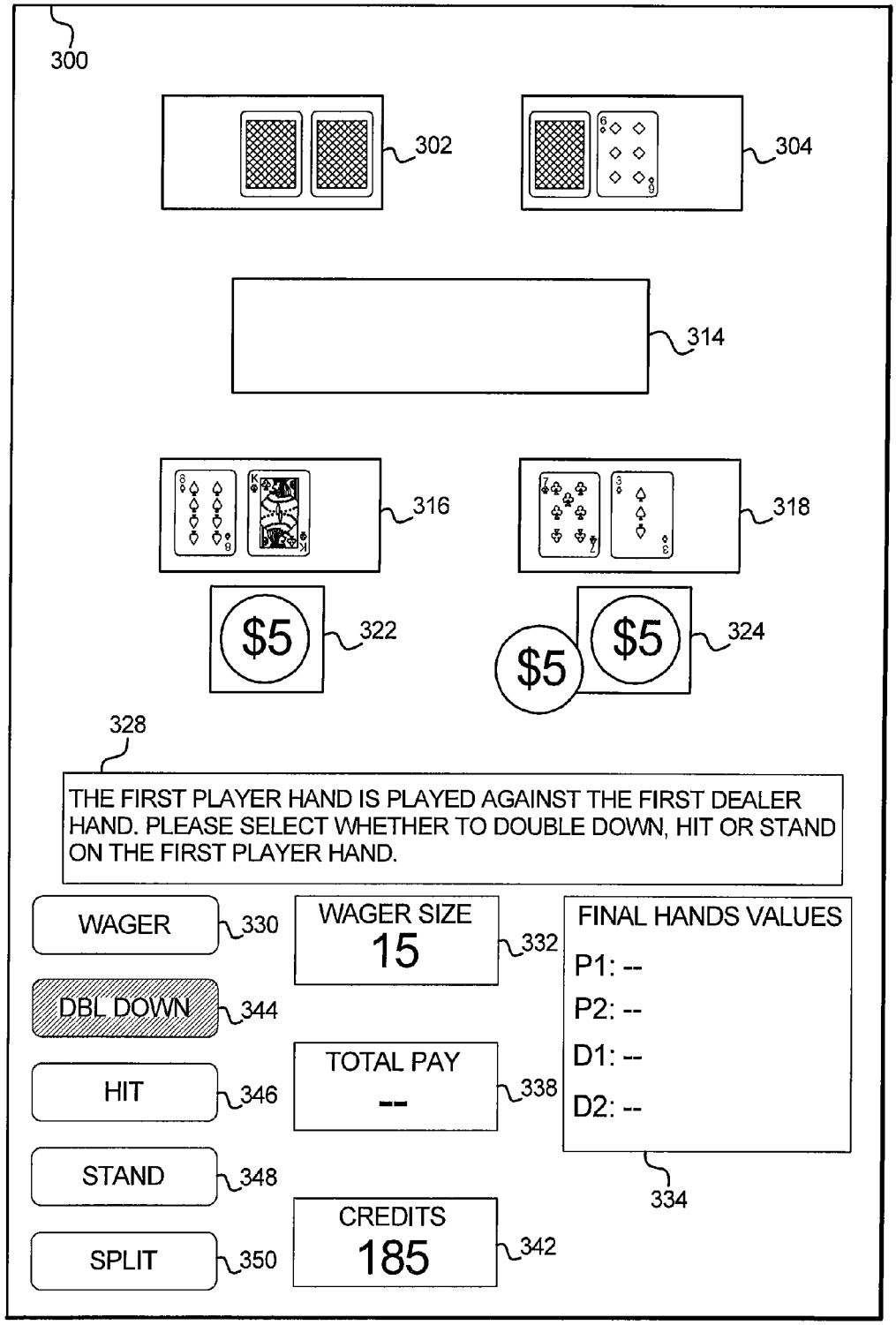

As shown in FIG. 3H, the gaming system 300 first resolves an outcome of the first player hand 318 and the first dealer hand 304. In this example, the player has a starting first player hand 318 value of ten. The player has the option to hit, stand or double-down on the first player hand 318. In this example play of the game, where the players initial cards total ten and the dealer's up-card is a six (i.e., a bust card) the player has chosen to double-down the original wager of five credits by activating the double-down input 344. The player's decision to double-down is indicated by the additional five credit wager token or chip in the first wager area 324, and by the additional credits in the pot size display 332, and in the total credits display 342. In this embodiment, if the player chooses to double-down, the player only receives one additional card. However, it should be appreciated that with other Blackjack rules, the player may be able to receive more than one card after doubling down.

Figure 3I:
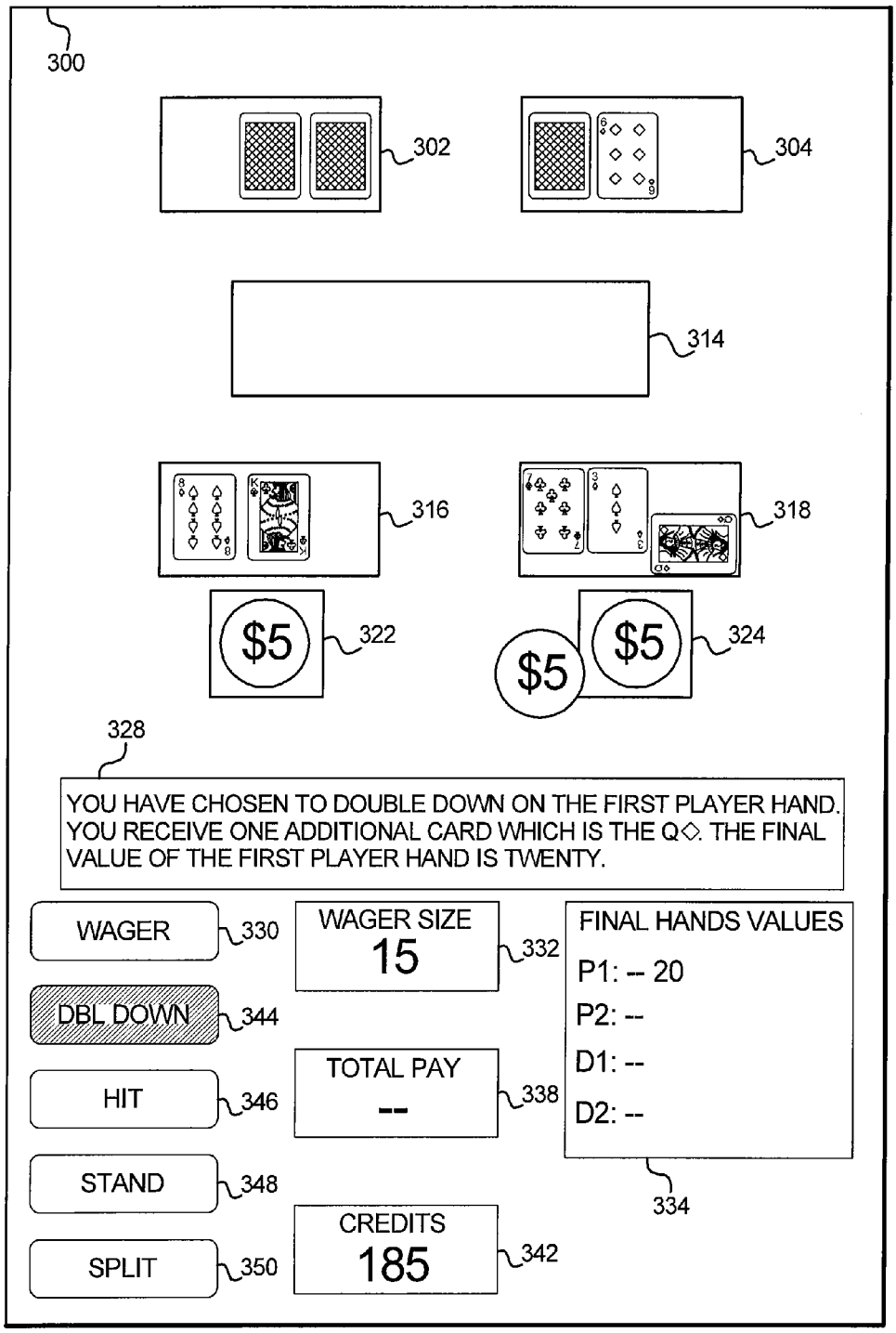

As shown in FIG. 3I, the message display 328 indicates that the player has chosen to double-down on the first player hand 318. The gaming system 300 causes one additional card to be dealt to the first player hand 318. In this play of the game, the additional card is the Q♦. Therefore, the final hand value of the first player hand is twenty, as indicated in the message display 328 and in the final hand value display 334.

Figure 3J:
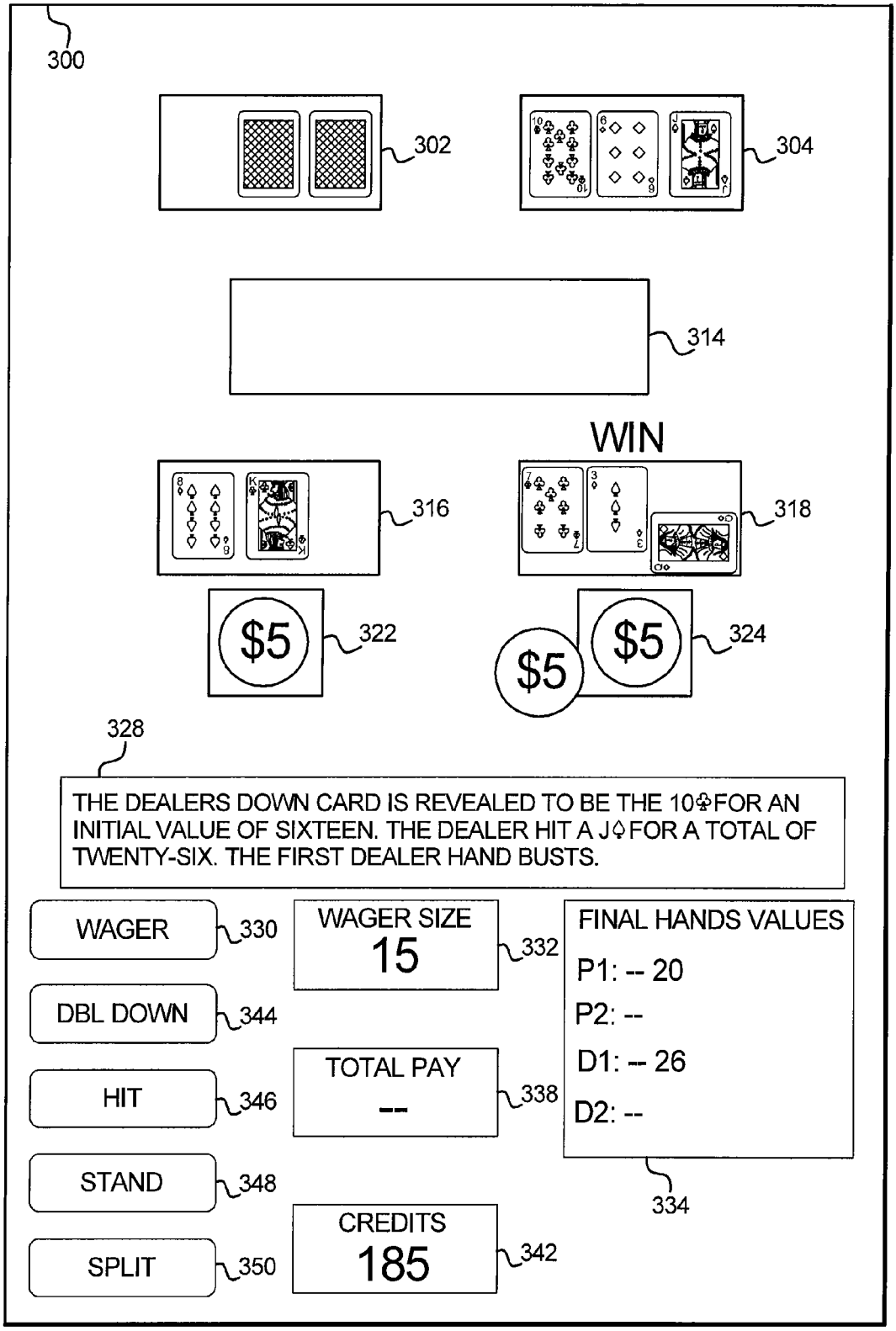

As shown in FIG. 3J, the gaming system 300 causes the dealers down-card in the first dealer hand 304 to be revealed. The down-card in the first dealer hand 304 is the 10♣, such that the initial value of the first dealer hand 304 is sixteen. As shown in FIG. 3J, the gaming system 300 hits on the first dealer hand 304 because the initial value of the first dealer 304 was less than seventeen, in accordance with the dealer rules. The first dealer hit card for the first dealer hand 304 is a J♠, Therefore, the total value of the first dealer hand is twenty-six, which is a bust. The player wins the first Blackjack hand as indicated in the message display 328 and by the win indication adjacent to the first player hand 318. The final hand value of the first dealer hand 304 is indicated to be twenty-six in the final hand value display 334. The first player hand 318 and the first dealer hand 304 have been resolved.

Figure 3K:
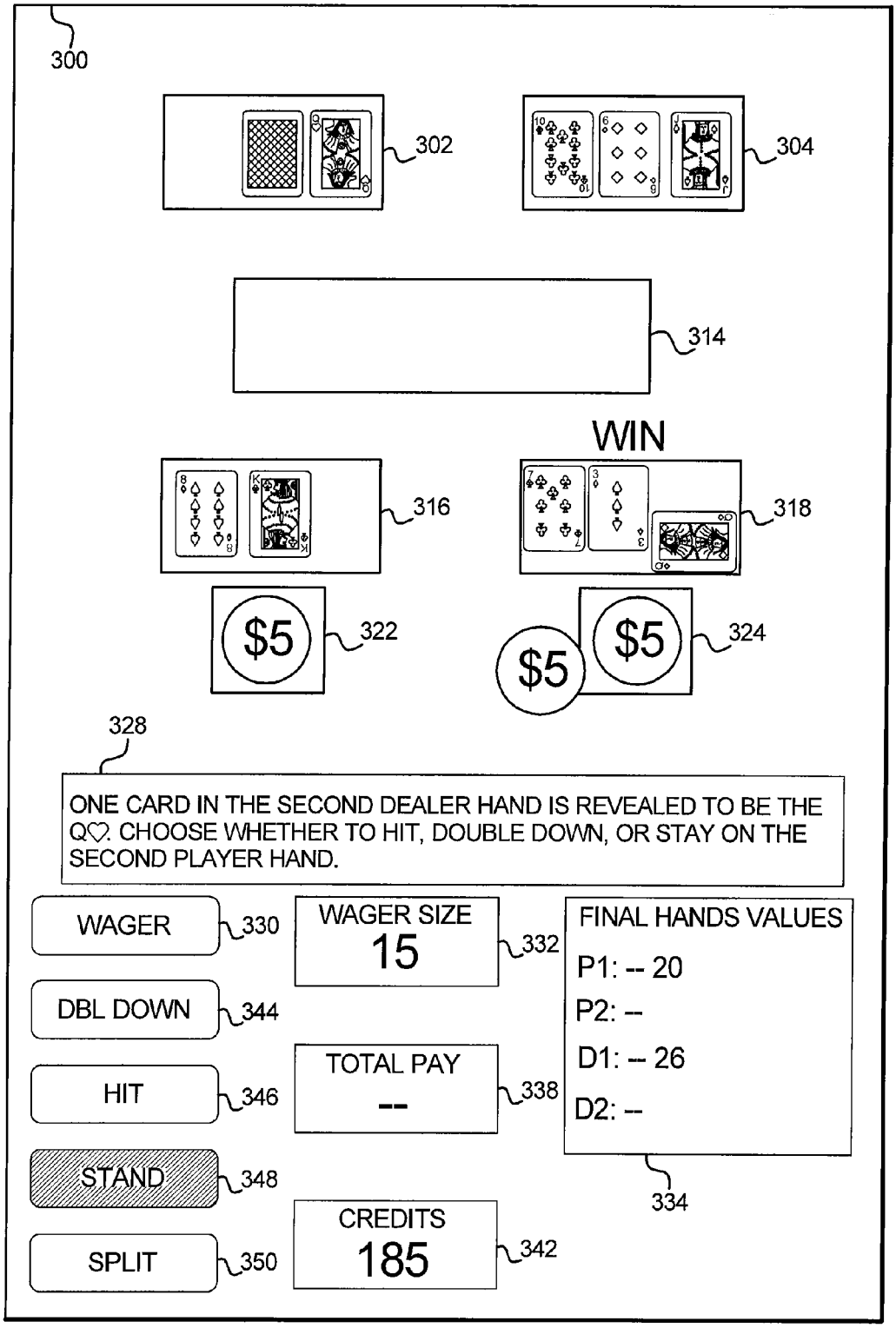

As shown in FIG. 3K, one of the cards in the second dealer hand 302 is revealed to be the Q♥, as also indicated in the message display 328. The gaming system 300 prompts the player to choose whether to hit, double-down, or stay on the second player hand 316, as indicated in the message display 328. In this example play of the game, because the player has a relatively good hand value of eighteen for the second player hand 316, the player chooses to stand with the first two cards, as indicated by the activated stand input 348.

Figure 3L:
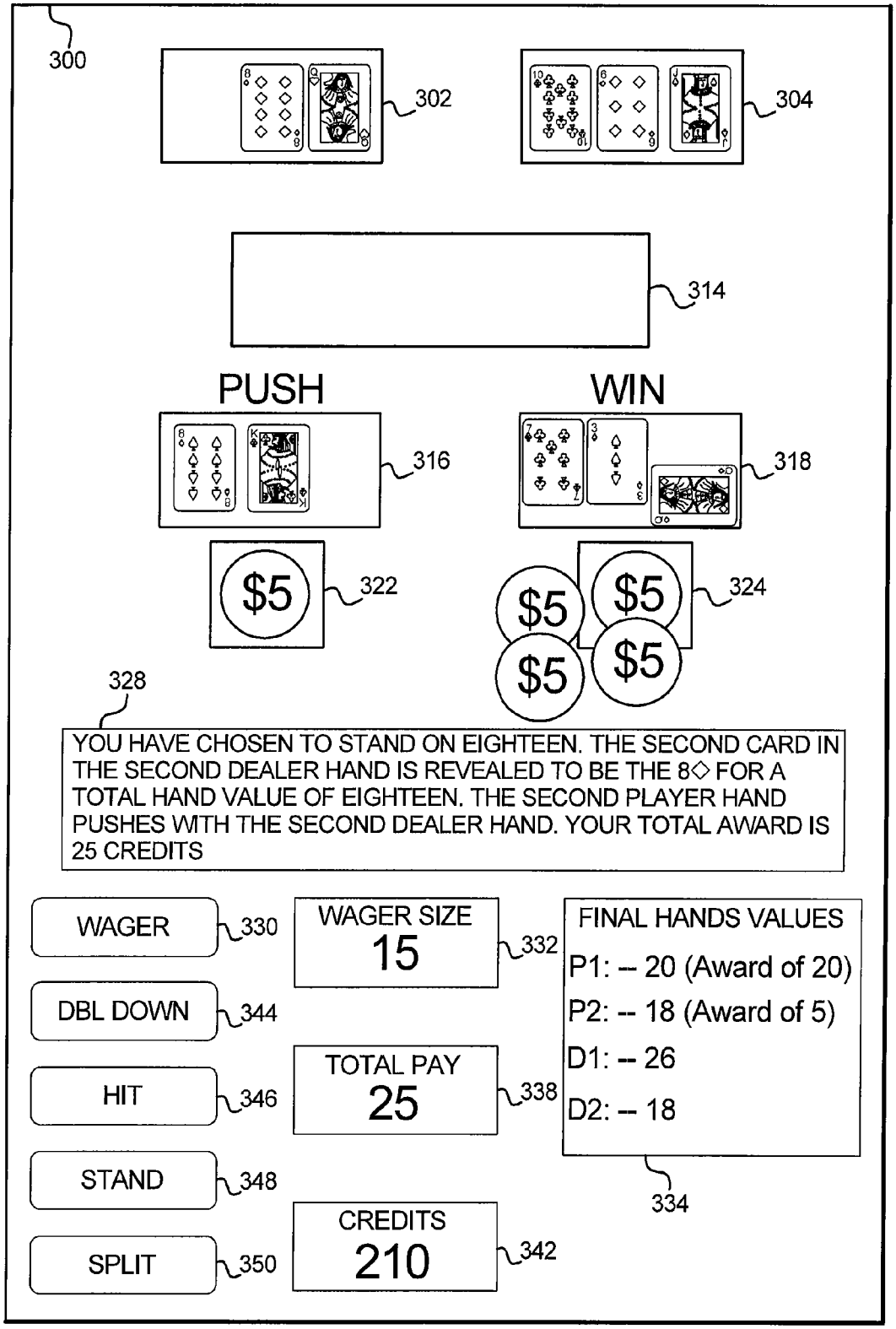

As shown in FIG. 3L, the second card in the second dealer hand 302 is revealed to be the 8♦, such that the total hand value of the second dealer hand 302 is eighteen, as also indicated in the message display 328. In this example embodiment, according the Blackjack dealer rules, the gaming system is not able to take a hit on the dealer hands when the hand value meets or exceeds a total of seventeen. Therefore the gaming system 300 stands with regard to the second dealer hand 302. In this examples the second player hand 316 pushes the second dealer hand 302 because both of the hands have a final hand value of eighteen, as also indicated in the final hand value display 334. The gaming system 300 provides the player with an award of twenty-five credits. This award includes twenty credits from the first player hand 318 and a return of the five credit wager on the second player hand 316 (i.e., due to the push). This ends this example round of play of the game. This ends this example round of play of the game.

In another embodiment as shown in FIG. 4A-4I, a multiple hand Blackjack game is played where the player must set cards in the first player hand and the second player hand without initially being able to simultaneously view the values of all four of the player cards. The gaming system 400 causes the values of the player cards to be revealed one at a time to the player. Then, after the player has set the revealed card into one of the two player hands, the gaming system 400 causes another one of the player cards to be revealed. This process continues until the last remaining player card is revealed and automatically moved to the only unfilled player hand. In this embodiment, the gaming system 400 includes a display that has a number of elements similar to the elements with regards to FIGS. 3A-3L. In this example play of the game, the player has placed a five credit wager on the first player hand 418 and a five credit wager on the second player hand 416 as also indicated in the message display 428 and in the first wager area 424 in the second wager area 422.

Figure 4A:
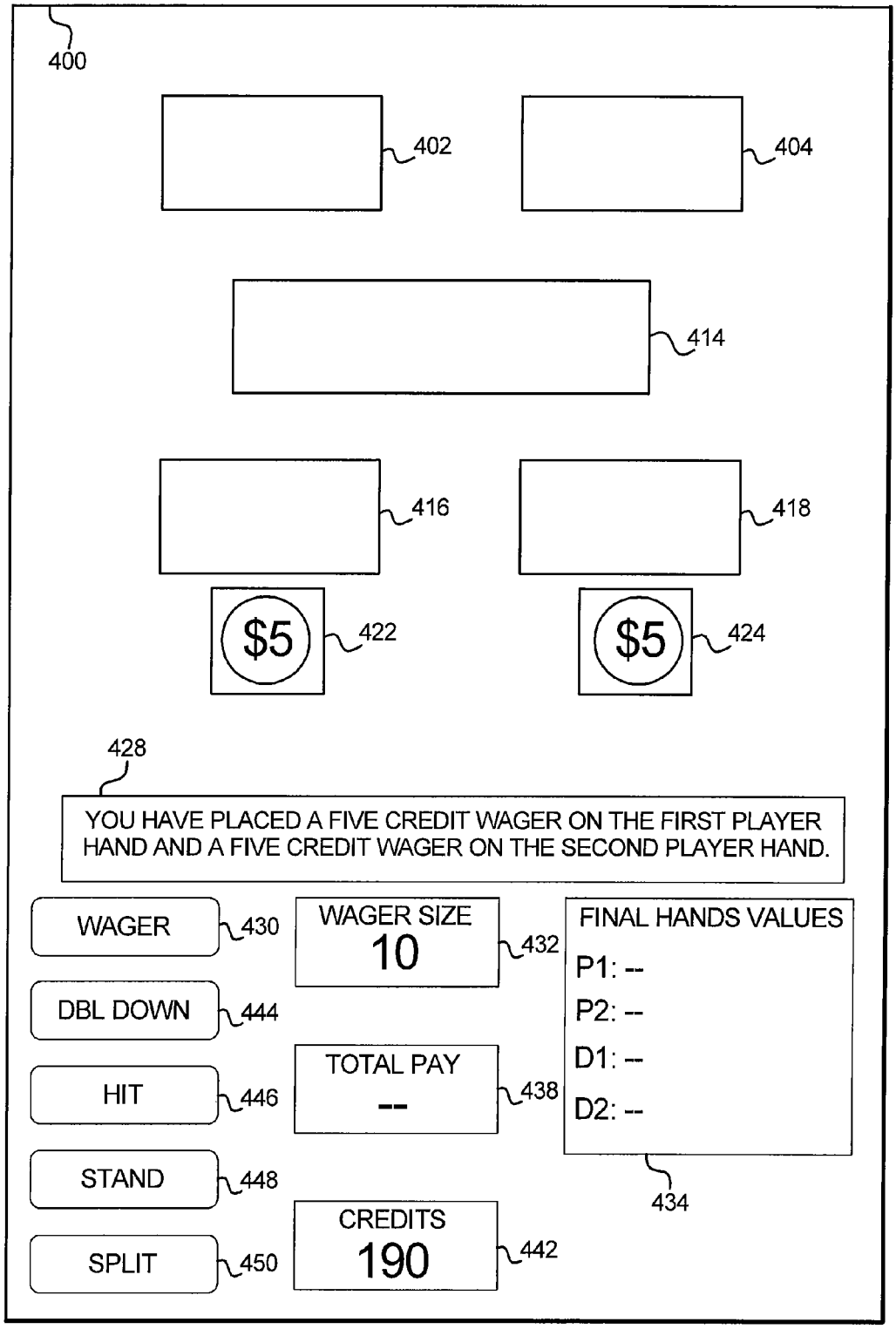
FIGS. 4A, 4B, 4C, 4D, 4E, 4F, 4G, 4H and 4I are top views of an example round of play of another embodiment of the Blackjack game, where the gaming system enables the player to set four player cards to form first and second player hands.
Figure 4B:
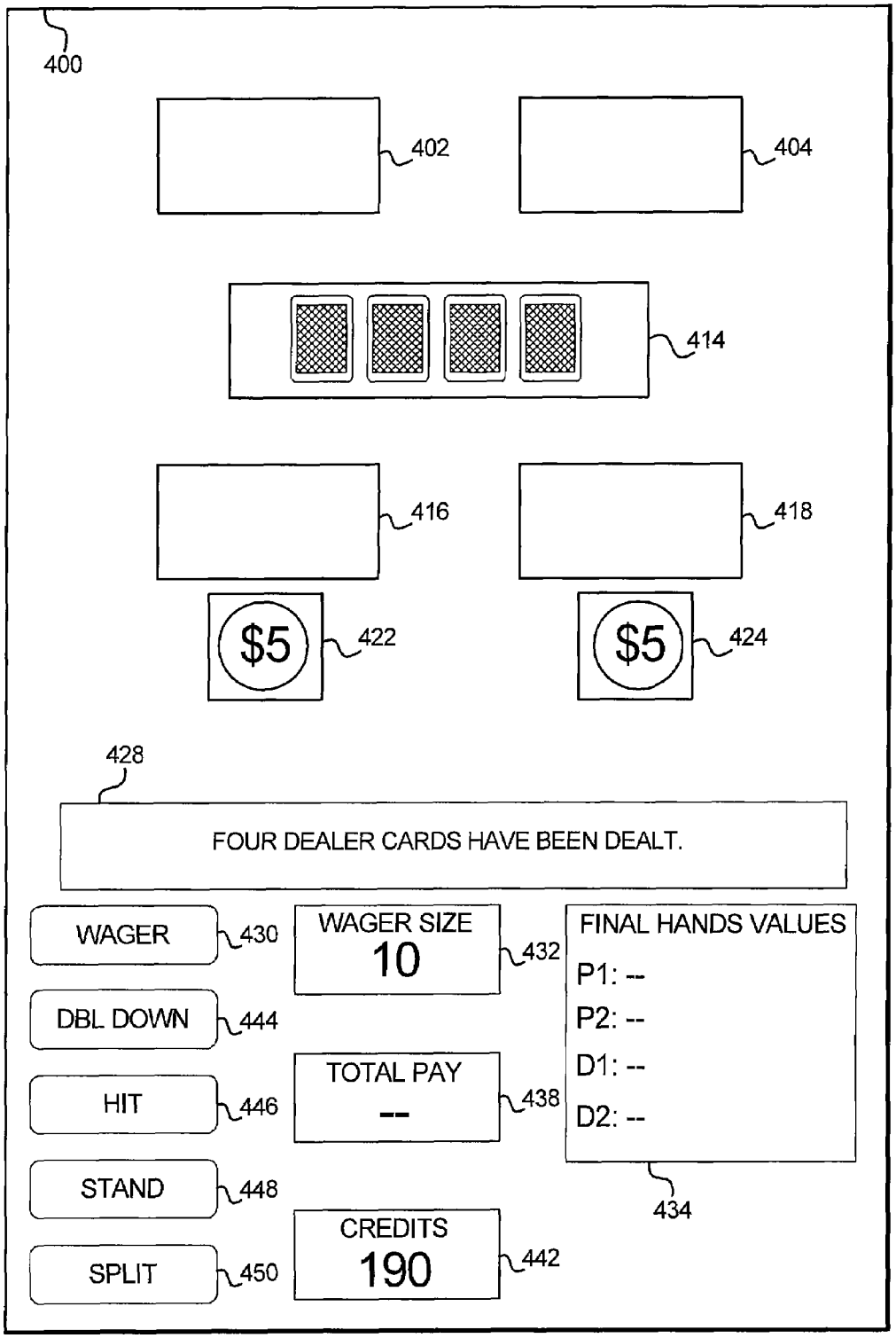
Figure 4C:
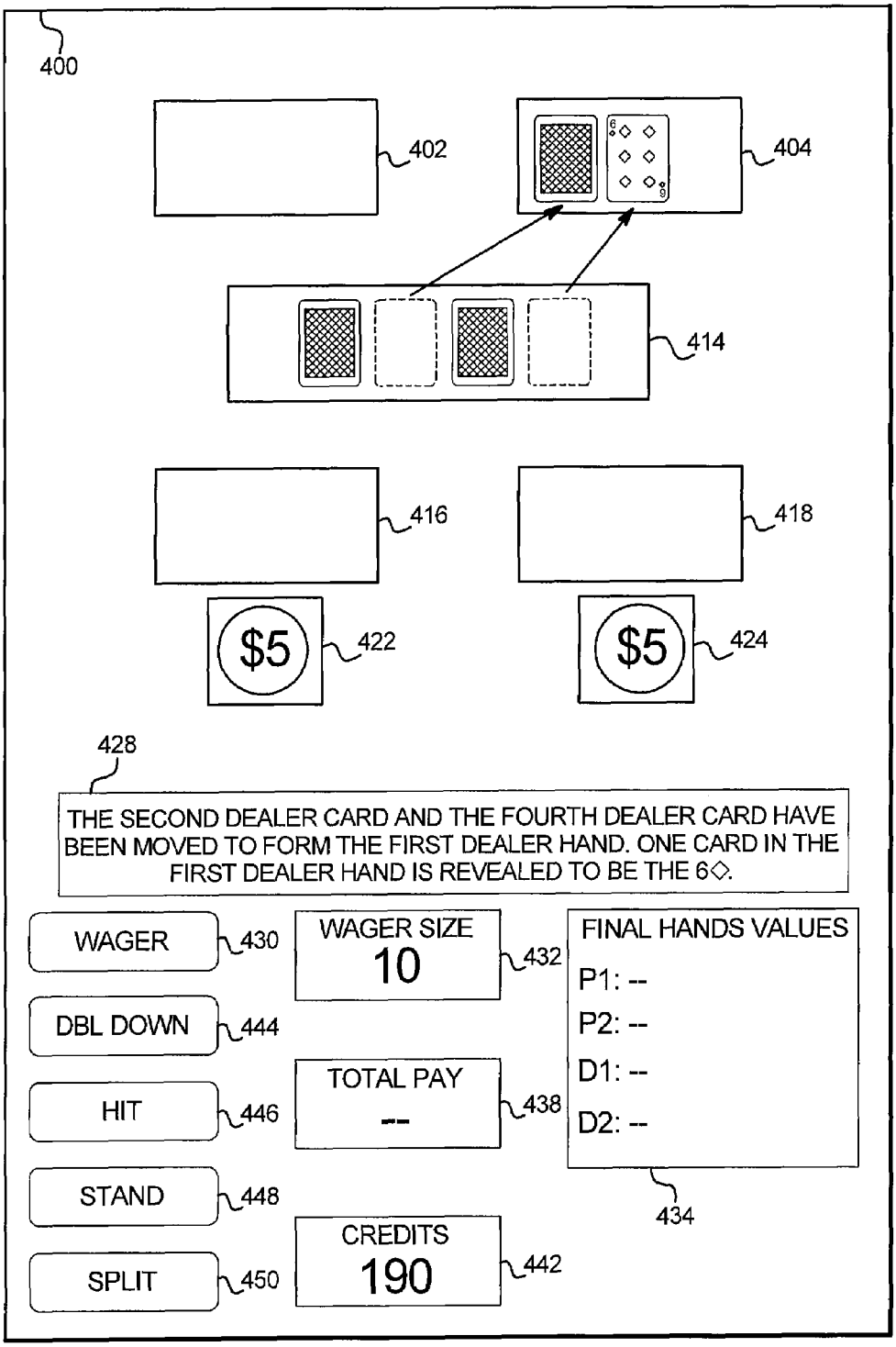
Figure 4D:
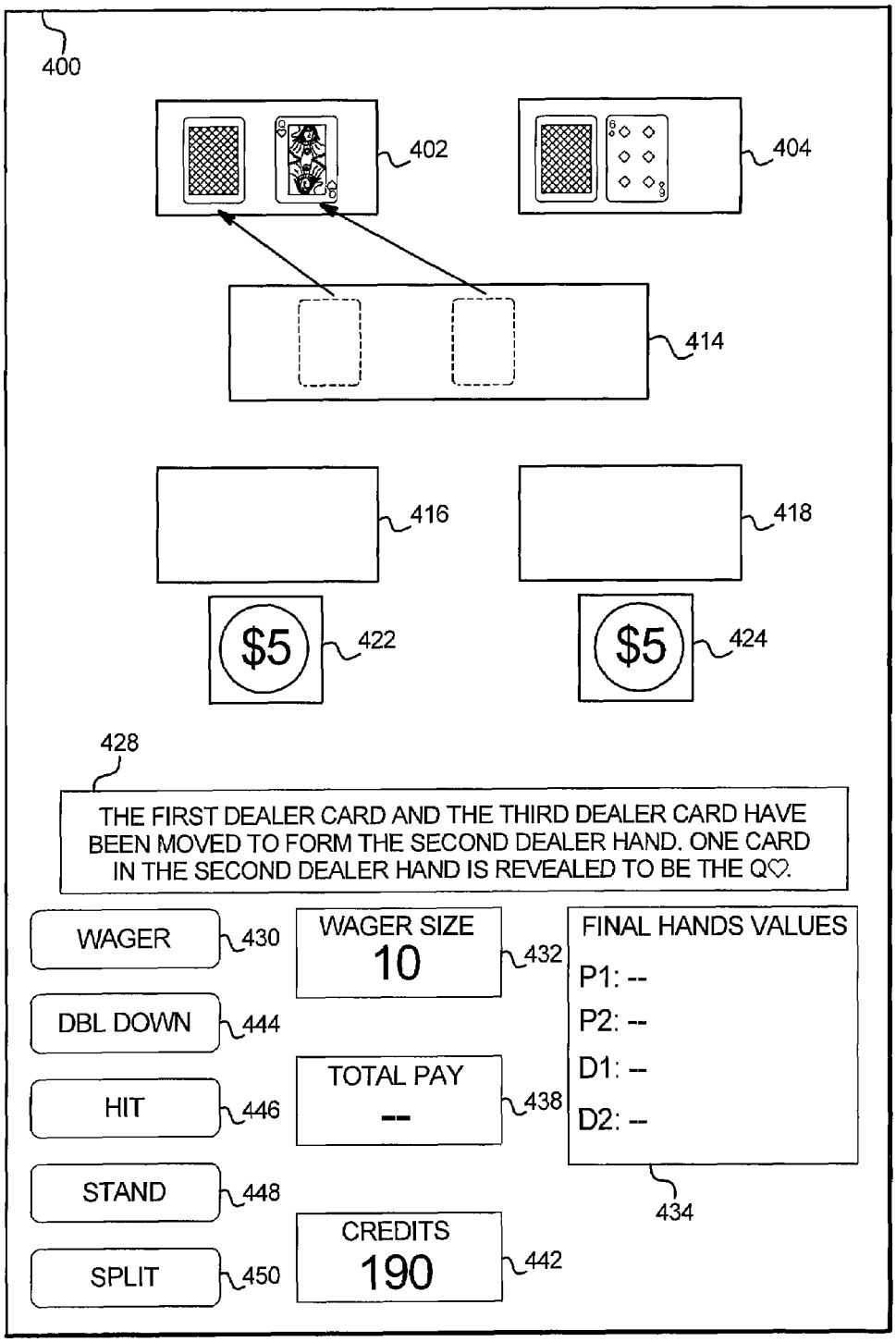

As shown in FIG. 4B, the gaming system 400 causes four dealer cards to be dealt in the card area 414. As shown in FIG. 4C, the gaming system 400 causes the second dealer card and the fourth dealer card to be moved from the card area 414 into the first dealer hand 404, as also indicated in the message display 428 and in the directional arrows pointing from the card area 414 to the first dealer hand 404. The gaming system 400 causes one of the cards in the first dealer hand 404 to be revealed. The value of this card is the 6♦, as also indicated in message display 428. As shown in FIG. 4D, the gaming system 400 causes the remaining first dealer card and third dealer card to be moved from the card area 414 to form the second dealer hand 402. Unlike the previous embodiment described with respect to FIGS. 3A to 3L, in this embodiment, the gaming system 400 also causes one card in the second dealer hand to be revealed to the player. In this example, the revealed card in the second dealer hand 402 is the Q♥. Therefore, in this embodiment, the player has more knowledge of the values of the cards in the first dealer hand 404 and the second dealer hand 402 prior to making any decisions with regard to setting the cards in the first player hand 418 and the second player hand 416. However, the advantage to the player in knowing more of the dealer cards is at least partially off set by the disadvantage of not being able to immediately know all of the values of the four player cards. As mentioned above in this embodiment, the gaming system 400 only reveals one of the player cards to the player at a time.

Figure 4E:
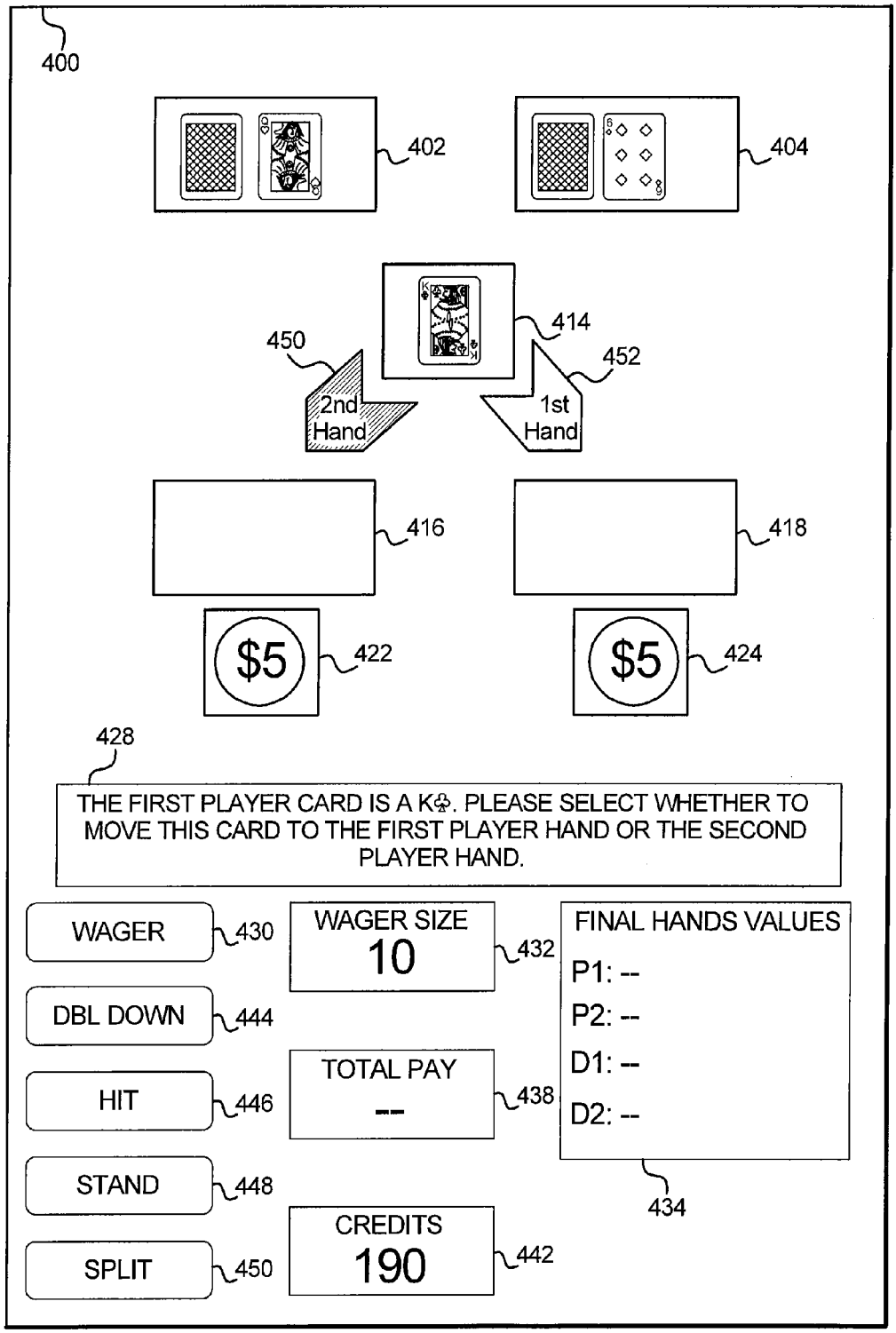

As shown in FIG. 4E, the gaming system 400 deals the first player card into the card area 414 which is a K♠, as also indicated in message display 428. In this embodiment, the display of the gaming system 400 also includes a number of inputs that enable the player to direct into which player hand the player cards will be moved. In this example, the gaming system 400 includes a second player hand input 450 and a first player hand input 452. As indicated in the message display 428, the gaming system 400 prompts the player to select whether to move the first player card from the card area 414 to the first player hand 418 or the second player hand 416. As shown in FIG. 4E by the activated second player hand input 450, the player has chosen to move the K♣, from the card area 414 into the second player hand 416.

Figure 4F:
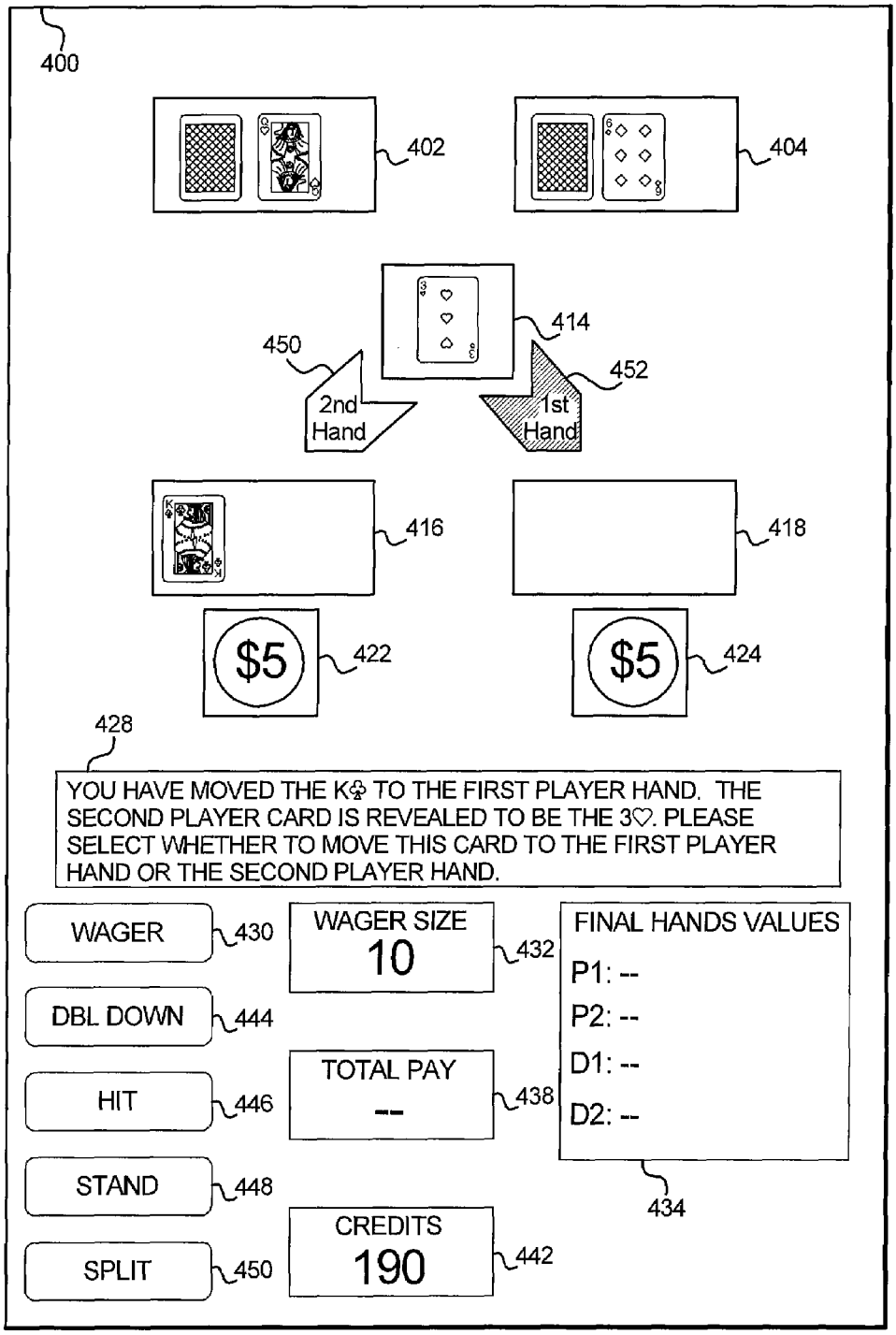

As shown in FIG. 4F, the K♣, the gaming system 400 has caused the first player card to be moved to the second player hand 416, also indicated in message display 428. The gaming system 400 then causes the second player card to be dealt into the card area 414, the value of the second player card is a 3♥. Although in this embodiment, the gaming system deals the player cards one at a time, it should be appreciated that in other embodiment the gaming system deals all four cards initially, but only reveals the dealt cards one at a time to the player. The gaming system 400 prompts the player to select whether to move second player card from the card area 414 into the first player hand 418 or the second player hand 416. In this example, if the player were to elect to move the 3♥ into the second player hand, the player would have a relatively poor starting hand of thirteen (i.e., the player may be relatively likely to bust if the player hits to the second player hand). Also, in this embodiment, because the player is able to view one of the cards in both of the first dealer hand 404 and the second dealer hand 402, the player has somewhat of an advantage in being able to determine the potential strength of both of the dealer hands. In this example play of the game, because the dealer has a relatively poor starting hand of six in the first dealer hand 404 (and would be relatively likely to bust anyway), the player elects to move the 3♥ from the card area 414 into the first player hand 418 as also indicated by the activated first hand input 452. By not moving the 3♥ into the second player hand 416, the player retains the possibility of forming a initially high valued second player hand 416 with another player card.

Figure 4G:
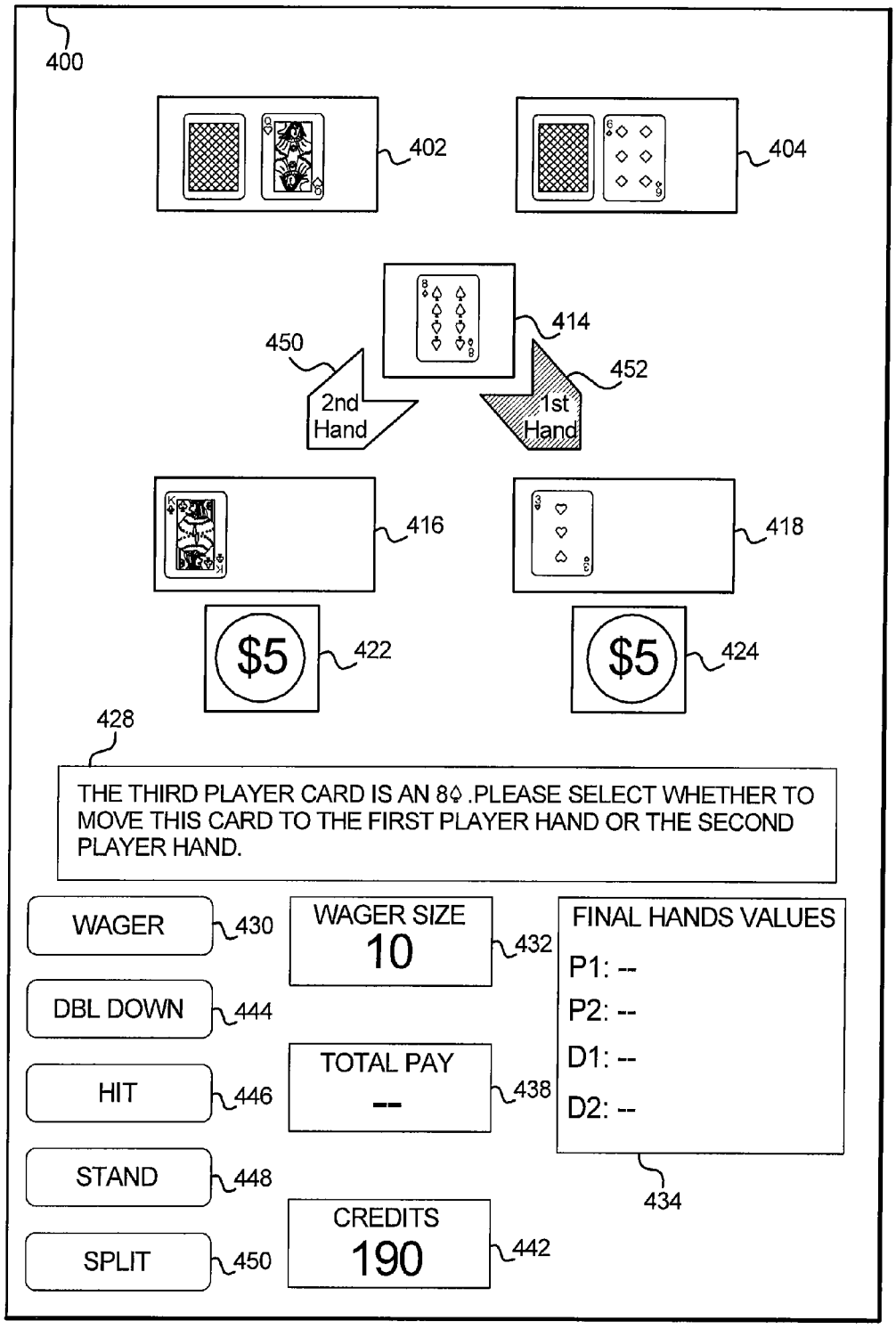

As shown in FIG. 4G, the 3♥ has been moved into the first player hand 418. The gaming system 400 deals the third player card into the card area 414. The gaming system reveals this third card which is the 8♠, The gaming system 400 then prompts the player to select whether to move the third player card from the card area 414 into the first player hand 418 or the second player hand 416. In this example, if the player were to choose to move the 8♠, into the second player hand 416, the player would have a relatively good starting hand value of eighteen. However, if the player were to choose to move the 8♠, into the first player hand 418, the player would have a double-down opportunity because the initial value of the first player hand 418 would be eleven. Moreover, the value of being able to double-down in the first player hand 418 is enhanced because the upward in the first dealer hand 404 is a six, which is a bust card. In this example play of the game, the player elects to move the 8♠, from the card area 414 into the first player hand 418, as indicated by the activated first hand input 452.

Figure 4H:
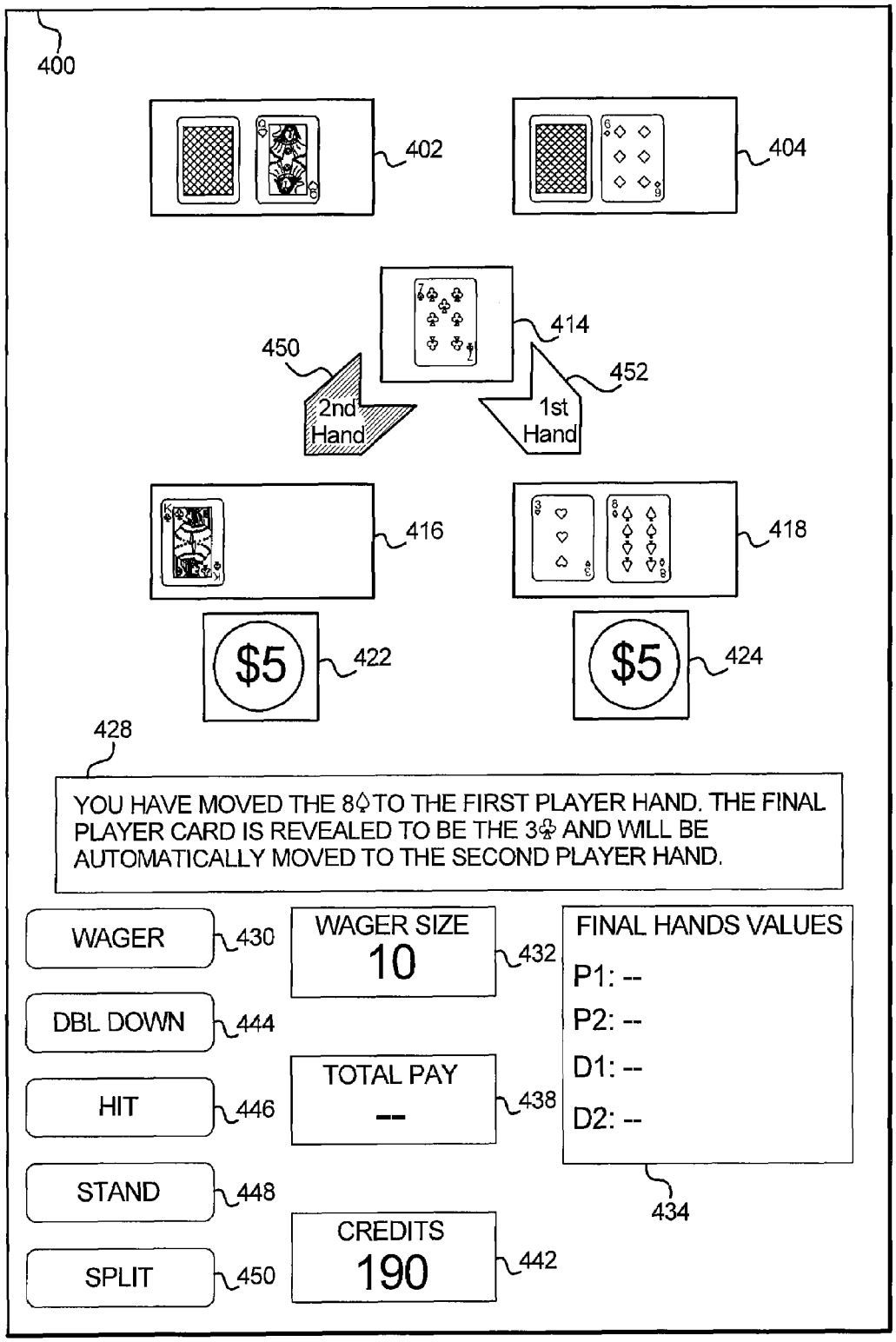

As shown in FIG. 4H, the gaming system 400 causes the 8♠ to be moved from the card area 414 to the first player hand 418, as also indicated in the message display 428. Therefore, the initial setting of the player cards in the first player hand 418 is complete. The gaming system 400 deals the fourth and final player card into the card area 414. The gaming system 400 reveals the fourth player card, which is the 7♠, As mentioned above, in this embodiment, the player must form two starting player hands of two cards each. Accordingly, because the first player hand 418 already has two cards, the gaming system 400 automatically moves the fourth player card (i.e., the 7♣,) into the second player hand 416, as also indicated by the activated second hand input 450 and the message display 428.

Figure 4I:
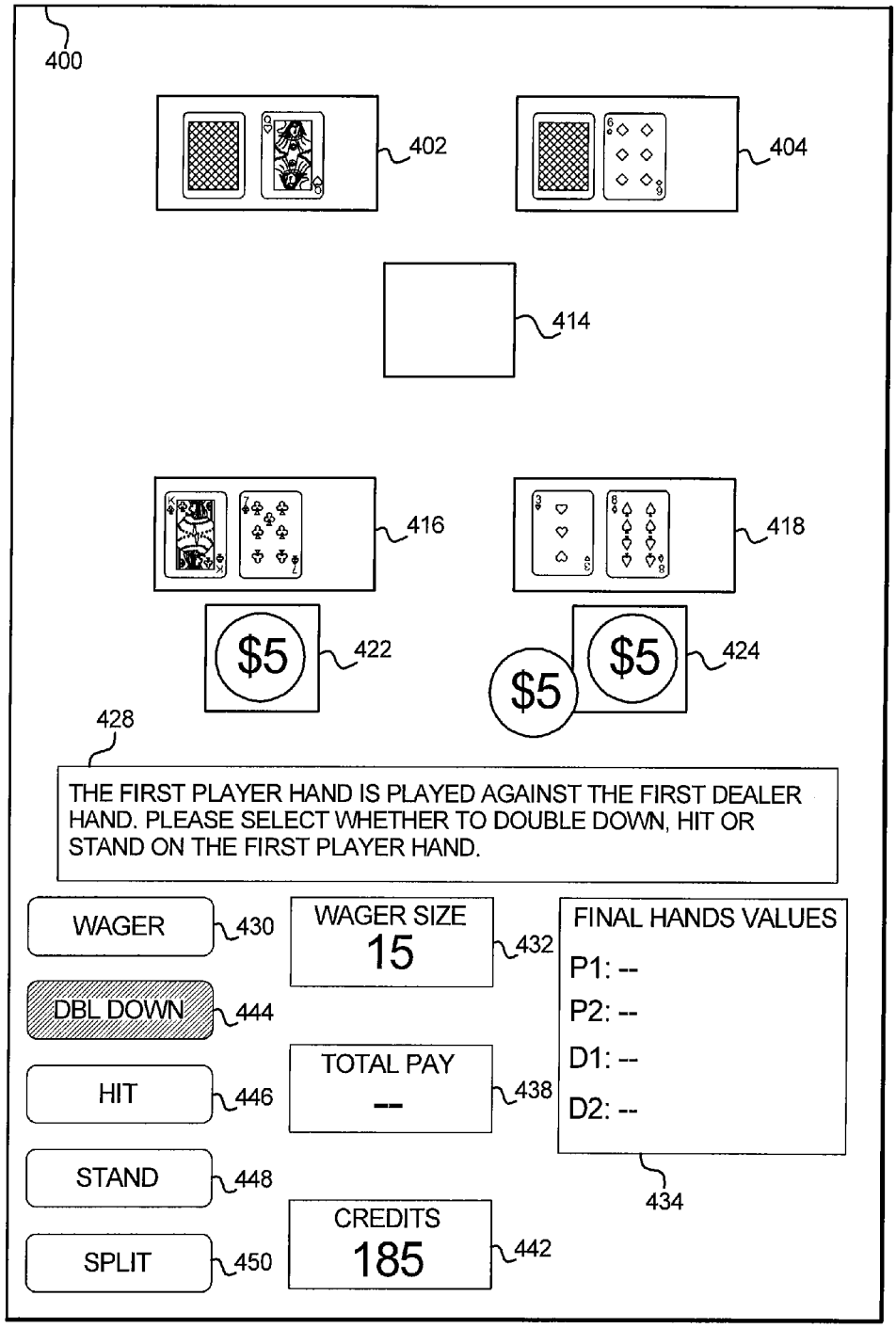

As shown in FIG. 4I, the initial value of the first player hand 418 is eleven and the value of the second player hand 416 is seventeen. As in the embodiment described above with respect to FIGS. 3A to 3L, the first player hand 418 is played against the first dealer hand 404. In this example, the player chooses to double-down on the first player hand 418 by activating the double-down input 444. Also, the gaming system 400 causes the total pot size to increase to 15 credits as indicated in the pot size display 432, and in the reduced number of credits in the total credits display 442. An additional five credit token is further indicated adjacent to or in the first wager area 424. It should be appreciated that once the first and second player hands and first and second dealer hands are initially set, the hands are resolved in a similar fashion to that described with respect to the embodiment in FIGS. 3A to 3L, or as according to commonly accepted Blackjack rules.

In one embodiment of a multi-hand Blackjack game, the order in which the player hands and the dealer hands are set is reversed. In this embodiment, the player places two equal stakes on each of a first player hand and a second player hand. The gaming device first deals four cards to the player, and enables the player to separate the four player cards into a two card first player hand and a two card second player hand. In this embodiment, because the player is setting the player cards in the player hands first, the player is not able to take into consideration the values of any of the four dealer cards (i.e., because they have not yet been dealt and revealed). After the player has set the cards in the player hand, the gaming system deals four dealer cards and causes the cards to be separated into a two card first dealer hand and a two card second dealer hand. Because the player has already set the cards in the player hands, the gaming system causes an up-card to be displayed in the first dealer hand and causes an up-card to be displayed in the second dealer hand. As described above, the gaming system first determines an outcome or resolves the first player and dealer hands, and then determines the outcome or resolved the second player and dealer hands, according to the player and dealer rules. After the hands are resolved, the gaming system provides the player with any award or collects the players wagers in accordance with wins, losses, and pushes.

In one embodiment of a multi-hand Blackjack game, player is able to view all four of the player cards when setting the player hands, and an up-card is revealed in each of the dealer hands prior to the player setting the player hands. In this embodiment, the player places two equal stakes on each of a first player hand and a second player hand. The gaming device first deals four dealer cards, and causes the dealer cards to be separated into a two card first dealer hand and a two card second dealer hand. The gaming system then reveals the up-cards in the first and second dealer hands. After these cards are revealed, the gaming system deals four player cards to the player. The player sets the four player cards into a two card first player hand and a two card second player hand with knowledge of both of the dealer up-cards.

In one embodiment, the gaming system separates the dealer cards but does not reveal any of the dealer cards as up-cards. This visually leads the player by example and also indicates to the player that the gaming system is not considering the values of the player cards when making the hand setting decisions for the dealer hands.

In another embodiment, only the up-card in the first dealer hand is revealed prior to the player setting the cards in the player hands. However, in this embodiment, after the player has set the cards in the player and prior to resolving or determining the outcome the first player and dealer hands, the up-card in the second dealer hand is revealed.

in one embodiment, the gaming system sets the card in the dealer hands such that the first dealer hand is stronger than the second dealer hand. In another embodiment, after pairing the four dealer cards into two dealer hands, the gaming system first determines which of the two dealer hands is the strongest hand and then randomly designates the strongest dealer hand to be the first or the second dealer hand. In this embodiment, the player must guess which of the first and second dealer hands will be the strongest hand.

In standard Blackjack table games, the first card dealt in the dealer hand is the up-card. In one embodiment, the gaming system makes a random determination as to which one of the two card in the dealer hand will be the up card. In another embodiment, the gaming system sets the strongest dealer card to be the up-card.

In one embodiment, the gaming system enables the player to place an optional side wager. In this embodiment, the gaming system provides the player with a bonus award is the first five visible cards are a predetermined combination of cards. In one example embodiment, where one of the cards in the first dealer hand is revealed as the up-card and then four player cards are revealed, this combination of player and dealer cards comprise the first five revealed cards. In one embodiment, the five revealed cards are evaluated based on standard five card poker rankings (e.g., Royal Straight Flush, Straight Flush, Four of a Kind, Full House, Flush, Straight, Three of a Kind, Two Pair, One Pair, High Card) and paid according to paytable. In another embodiment, the gaming system provides the player with a bonus award is the first five visible player cards are a predetermined combination of cards. In another embodiment, the gaming system provides the player with a bonus award is the first four visible player cards are a predetermined combination of cards.

In one embodiment, the gaming system includes player hand setting rules that require at least one of the two-card player Blackjack hands to have a strength greater than another one of the two-card player Blackjack hands. In this embodiment, the gaming system also includes dealer hand setting rules for forming the multiple two-card dealer Blackjack hands. In a play of various embodiments of the game, the formed higher ranking player hand competes against a corresponding higher ranking dealer hand, and the formed lower ranking player hand competes against the lower ranking dealer hand.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A Blackjack gaming system comprising:

at least one input device;

at least one processor;

at least one display device; and at least one memory device storing a plurality of instructions which when executed by the at least one processor, cause the at least one processor to operate with the at least one display device and the at least one input device to:

(a) enable at least one wager to be placed, (b) deal a plurality of dealer cards and deal a plurality of player cards, (c) form a two-card first dealer hand and a two-card second dealer hand from the dealer cards, (d) receive at least one input to form a two-card first player hand and a two-card second player hand from the player cards, (e) enable the two-card first player hand to be modified according to at least one player rule, (f) if the first player hand is complete, modify the two-card first dealer hand according to at least one dealer rule, (g) enable the two-card second player hand to be modified according to at least one player rule, (h) if the second player hand is complete, modify the two-card second dealer hand according to at least one dealer rule, (i) determine if the resulting first player hand beats the first dealer hand and determine if the resulting second player hand beats the second dealer hand, and (j) unless the first player hand loses to the first dealer hand and unless the second player hand loses to the second dealer hand, display a payment.

2. The gaming system of claim 1, wherein prior to enabling the two-card first player hand to be modified according to the at least one player rule, the at least one processor operates with the at least one display device and the at least one input device to reveal one of the cards in the first dealer hand.

3. The gaming system of claim 1, wherein prior to enabling the two-card first player hand to be modified according to the at least one player rule, the at least one processor operates with the at least one display device and the at least one memory device to reveal one of the cards in the first dealer hand and one of the cards in the second dealer hand.

4. The gaming system of claim 1, wherein the at least one processor operates with the at least one display device and the at least one memory device to form a stronger two-card first dealer hand than the two-card second dealer hand.

5. The gaming system of claim 4, wherein the at least one processor operates with the at least one display device and the at least one memory device to form a strong dealer hand and a weak dealer hand from the dealer cards, and assign the strong and weak dealer hands as the first and second two-card dealer hands based on at least one of: a random determination; values of the player cards; and past player card setting and hand setting information.

6. The gaming system of claim 1, wherein prior to enabling the two-card first player hand to be modified according to the at least one player rule, the at least one processor operates with the at least one display device and the at least one memory device to reveal one of the cards in the first dealer hand, and wherein prior to enabling the two-card second player hand to be modified according to at least one player rule, the at least one processor operates with the at least one display device and the at least one memory device to reveal one of the cards in the second dealer hand.

7. The gaming system of claim 1, wherein the two-card first dealer hand and the two-card second dealer hand are formed in the order that the dealer cards are dealt.

8. A Blackjack gaming system comprising:

at least one input device;

at least one processor;

at least one display device; and at least one memory device storing a plurality of instructions which when executed by the at least one processor, cause the at least one processor to operate with the at least one display device and the at least one input device to, for a play of a Blackjack game:

(a) enable at least one wager to be placed, (b) deal a plurality of dealer cards and deal a plurality of player cards, (c) form a first two-card dealer hand and a second two-card dealer hand from the dealer cards, (d) sequentially, and until at least a first two-card player hand and a second two-card player hand have been formed, reveal one of the player cards and receive at least one input to assign said player card to an incomplete one of the first two-card player hand and the second two-card player hand, (e) enable the first two-card player hand to be modified according to at least one player rule, (f) if the first player hand is complete, modify the first two-card dealer hand according to at least one dealer rule, (g) enable the second two-card player hand to be modified according to at least one player rule, (h) if the second player hand is complete, modifying the second two-card dealer hand according to at least one dealer rule, (i) determine if the resulting first player hand beats the first dealer hand and determine if the resulting second player hand beats the second dealer hand, and (j) unless the first player hand loses to the first dealer hand and unless the second player hand loses to the second dealer hand, display a payment.

9. The gaming system of claim 8, wherein one of the cards in each of the first and second two-card dealer hands is revealed as an up-card after the first and second two-card player hands have been set.

10. The gaming system of claim 8, wherein prior to enabling the first two-card player hand to be modified according to the at least one player rule, the at least one processor operates with the at least one display device and the at least one memory device to reveal one of the cards in the first dealer hand.

11. The gaming system of claim 8, wherein prior to enabling the first two-card player hand to be modified according to the at least one player rule, the at least one processor operates with the at least one display device and the at least one memory device to reveal one of the cards in the first dealer hand and one of the cards in the second dealer hand.

12. The gaming system of claim 8, wherein the at least one processor operates with the at least one display device and the at least one memory device to form a stronger first two-card dealer hand than the second two-card dealer hand.

13. The gaming system of claim 8, wherein the at least one processor operates with the at least one display device and the at least one memory device to:

form a strong dealer hand and a weak dealer hand from the dealer cards, and assign the strong and weak dealer hands as the first and second two-card dealer hands based on at least one of: a random determination; values of the player cards; and past player card setting and hand setting information.

14. The gaming system of claim 8, wherein prior to enabling the first two-card player hand to be modified according to at least one player rule, the at least one processor operates with the at least one display device and the at least one memory device to reveal one of the cards in the first dealer hand, and wherein prior to enabling the second two-card player hand to be modified according to at least one player rule, the at least one processor operates with the at least one display device and the at least one memory device to reveal one of the cards in the second dealer hand.

15. The gaming system of claim 8, wherein the first two-card dealer hand and the second two-card dealer hand are formed in the order that the dealer cards are dealt.

16. A method of operating a Blackjack game, the method comprising causing at least one processor to execute a plurality of instructions stored in at least one memory device to operate with at least one display device and at least one input device to:

(a) enable at least one wager to be placed, (b) display a plurality of dealer cards and display a plurality of player cards, (c) form a first two-card dealer hand and a second two-card dealer hand from the dealer cards, (d) receive at least one input to form a first two-card player hand and a second two-card player hand from the player cards, (e) enable the first two-card player hand to be modified according to at least one player rule, (f) if the first player hand is complete, modify the first two-card dealer hand according to at least one dealer rule, (g) enable the second two-card player hand to be modified according to at least one player rule, (h) modify the second two-card dealer hand according to at least one dealer rule, (i) determine if the resulting first player hand beats the first dealer hand and determine if the resulting second player hand beats the second dealer hand, and (j) unless the first player hand loses to the first dealer hand and unless the second player hand loses to the second dealer hand, display a payment.

17. The method of claim 16, which includes causing the at least one processor to execute the plurality of instructions stored in the at least one memory device to operate with the at least one display device to reveal one of the cards in the first dealer hand prior to enabling the first two-card player hand to be modified according to the at least one player rule.

18. The gaming system of claim 16, which includes causing the at least one processor to execute the plurality of instructions stored in the at least one memory device to operate with the at least one display device to reveal one of the cards in the first dealer hand and one of the cards in the second dealer hand prior to enabling the first two-card player hand to be modified according to the at least one player rule.

19. The method of claim 16, which includes causing the at least one processor to execute the plurality of instructions stored in the at least one memory device to operate with the at least one display device to form a stronger first two-card dealer hand than the second two-card dealer hand.

20. The method of claim 19, which includes causing the at least one processor to execute the plurality of instructions stored in the at least one memory device to operate with the at least one display device to:

form a strong dealer hand and a weak dealer hand from the dealer cards, and assign the strong and weak dealer hands as the first and second two-card dealer hands based on at least one of: a random determination; knowledge of the player cards; and past player card and hand setting trends.

21. The method of claim 16, wherein prior to causing the at least one processor to execute the plurality of instructions stored in the at least one memory device to operate with the at least one display device and the at least one input device to enable the first two-card player hand to be modified according to at least one player rule, the at least one processor operates with the at least one display device and the at least one memory device to reveal one of the cards in the first dealer hand, and wherein prior to causing the at least one processor to execute the plurality of instructions stored in the at least one memory device to operate with the at least one display device and the at least one input device to enable the second two-card player hand to be modified according to at least one player rule, the at least one processor operates with the at least one display device and the at least one memory device to reveal one of the cards in the second dealer hand.

22. The method of claim 16, wherein the first two-card dealer hand and the second two-card dealer hand are formed in the order that the dealer cards are displayed.

23. A method of operating a Blackjack game, the method comprising causing at least one processor to execute a plurality of instructions stored in at least one memory device to operate with at least one display device and at least one input device to:

(a) enable at least one wager to be placed, (b) display a plurality of dealer cards and display a plurality of player cards, (c) form a first two-card dealer hand and a second two-card dealer hand from the dealer cards, (d) sequentially, and until at least a first two-card player hand and a second two-card player hand have been formed, reveal one of the player cards and receive at least one input to assign said player card to an incomplete one of the first two-card player hand and the second two-card player hand, (e) enable the first two-card player hand to be modified according to at least one player rule, (f) if the first player hand is complete, modify the first two-card dealer hand according to at least one dealer rule, (g) enable the second two-card player hand to be modified according to at least one player rule, (h) if the second player hand is complete, modify the second two-card dealer hand according to at least one dealer rule, (i) determine if the resulting first player hand beats the first dealer hand and determine if the resulting second player hand beats the second dealer hand, and (j) unless the first player hand loses to the first dealer hand and unless the second player hand loses to the second dealer hand, display a payment.

24. The method of claim 23, which includes causing the at least one processor to execute the plurality of instructions stored in the at least one memory device to operate with the at least one display device to reveal one of the cards in the first dealer hand prior to enabling the first two-card player hand to be modified according to the at least one player rule.

25. The method of claim 23, which includes causing the at least one processor to execute the plurality of instructions stored in the at least one memory device to operate with the at least one display device to reveal one of the cards in the first dealer hand and one of the cards in the second dealer hand prior to enabling the first two-card player hand to be modified according to the at least one player rule.

26. The method of claim 23, which includes causing the at least one processor to execute the plurality of instructions stored in the at least one memory device to operate with the at least one display device to form a stronger first two-card dealer hand than the second two-card dealer hand.

27. The method of claim 26, which includes causing the at least one processor to execute the plurality of instructions stored in the at least one memory device to operate with the at least one display device to:

form a strong dealer hand and a weak dealer hand from the dealer cards; and assign the strong and weak dealer hands as the first and second two-card dealer hands based on at least one of: a random determination; values of the player cards; and past player card setting and hand setting information.

28. The method of claim 23, wherein prior to causing the at least one processor to execute the plurality of instructions stored in the at least one memory device to operate with the at least one display device and the at least one input device to enable the first two-card player hand to be modified according to at least one player rule, the at least one processor operates with the at least one display device and the at least one memory device to reveal one of the cards in the first dealer hand, and wherein prior to causing the at least one processor to execute the plurality of instructions stored in the at least one memory device to operate with the at least one display device and the at least one input device to enable the second two-card player hand to be modified according to at least one player rule, the at least one processor operates with the at least one display device and the at least one memory device to reveal one of the cards in the second dealer hand.

29. The method of claim 23, wherein the first two-card dealer hand and the second two-card dealer hand are formed in the order that the dealer cards are displayed.

* * * * *

UNITED STATES PATENT AND TRADEMARK OFFICE

CERTIFICATE OF CORRECTION

PATENT NO. : 8,197,319 B2
APPLICATION NO. : 11/938034
DATED : June 12, 2012
INVENTOR(S) : Mark C. Nicely It is certified that error appears in the above-identified patent and that said Letters Patent is hereby corrected as shown below:

IN THE CLAIMS

In Claim 1, Column 26, Line 21, between “to” and “at” insert --the--.
In Claim 1, Column 26, Line 23, between “to” and “at” insert --the--.
In Claim 1, Column 26, Line 28, before “first player” insert --resulting--.
In Claim 1, Column 26, Line 29, before “second player” insert --resulting--.
In Claim 5, Column 26, Line 48, after “to” insert --:--.
In Claim 6, Column 26, Line 61, between “to” and “at” insert --the--.
In Claim 7, Column 26, Line 67, replace the first instance of “the” with --an--.
In Claim 8, Column 27, Line 27, between “to” and “at” insert --the--.
In Claim 8, Column 27, Line 29, between “to” and “at” insert --the--.
In Claim 8, Column 27, Line 34, before “first player” insert --resulting--.
In Claim 8, Column 27, Line 35, before “second player” insert --resulting--.
In Claim 14, Column 28, Line 1, between “to” and “at” insert --the--.
In Claim 14, Column 28, Line 5, between “to” and “at” insert --the--.
In Claim 15, Column 28, Line 11, replace the first instance of “the” with --an--.
In Claim 16, Column 28, Line 13, after “comprising” insert --:--.
In Claim 16, Column 28, Line 33, between “to” and “at” insert --the--.
In Claim 16, Column 28, Line 34, between “to” and “at” insert --the--.
In Claim 16, Column 28, Line 39, before “first player” insert --resulting--.
In Claim 16, Column 28, Line 40, before “second player” insert --resulting--.
In Claim 18, Column 28, Line 48, replace “gaming system” with --method--.
In Claim 21, Column 29, Line 8, between “to” and “at” insert --the--.
In Claim 21, Column 29, at about Line 15, between “to” and “at” insert --the--.
In Claim 22, Column 29, at about Line 21, replace “the order” with --an order--.
In Claim 23, Column 29, at about Line 23, after “comprising” insert --:--.
In Claim 23, Column 29, Line 45, between “to” and “at” insert --the--.
In Claim 23, Column 29, Line 47, between “to” and “at” insert --the--.
In Claim 23, Column 30, Line 1, before “first player” insert --resulting--.

Signed and Sealed this
Eighteenth Day of December, 2012

David J. Kappos

David J. Kappos
*Director of the United States Patent and Trademark Office*

IN THE CLAIMS

In Claim 23, Column 30, Line 2, before “second player” insert --resulting--.
In Claim 28, Column 30, Line 37, between “to” and “at” insert --the--.
In Claim 28, Column 30, Line 44, between “to” and “at” insert --the--.
In Claim 29, Column 30, Line 50, replace the first instance of “the” with --an--.